US011848473B2

(12) United States Patent
Rospsha

(10) Patent No.: US 11,848,473 B2
(45) Date of Patent: Dec. 19, 2023

(54) METHOD OF CONSTRUCTING A CAVITY COMPRISING FORMING ONE OR MORE CONDUCTIVELY COATED OPENINGS IN A PLURALITY OF BOARDS AND PLACING A ROD OR TUNING POST THEREIN

(71) Applicant: Nimrod Rospsha, Rishon-le-Zion (IL)

(72) Inventor: Nimrod Rospsha, Rishon-le-Zion (IL)

( * ) Notice: Subject to any disclaimer, the term of this patent is extended or adjusted under 35 U.S.C. 154(b) by 221 days.

(21) Appl. No.: 17/299,339

(22) PCT Filed: Dec. 5, 2019

(86) PCT No.: PCT/IL2019/051334
§ 371 (c)(1),
(2) Date: Jun. 3, 2021

(87) PCT Pub. No.: WO2020/115752
PCT Pub. Date: Jun. 11, 2020

(65) Prior Publication Data

US 2022/0059917 A1 Feb. 24, 2022

(30) Foreign Application Priority Data

Dec. 6, 2018 (IL) ..... 263546

(51) Int. Cl.

| | |
|---|---|
| ***H01P 11/00*** | (2006.01) |
| ***H01P 3/12*** | (2006.01) |
| ***H01P 1/208*** | (2006.01) |
| ***H01P 7/06*** | (2006.01) |

(52) U.S. Cl.
CPC ..... *H01P 11/007* (2013.01); *H01P 1/2088* (2013.01); *H01P 3/12* (2013.01); *H01P 7/065* (2013.01); *H01P 11/002* (2013.01)

(58) Field of Classification Search
CPC ..... H01P 1/2088; H01P 11/007; H01P 7/065; H01P 1/2002
USPC ..... 333/208
See application file for complete search history.

(56) References Cited

U.S. PATENT DOCUMENTS

| | | | | |
|---|---|---|---|---|
| 2006/0232364 | A1 | 10/2006 | Koh et al. | |
| 2008/0297283 | A1* | 12/2008 | Byun et al. | H01P 5/107 333/21 R |
| 2012/0242425 | A1 | 9/2012 | Burke et al. | |
| 2012/0256707 | A1* | 10/2012 | Leiba et al. | H01P 3/121 216/13 |
| 2014/0145883 | A1 | 5/2014 | Baks et al. | |

(Continued)

FOREIGN PATENT DOCUMENTS

| | | | |
|---|---|---|---|
| CN | 101517823 | A | 8/2009 |
| CN | 101577358 | A | 11/2009 |
| CN | 102361113 | A | 2/2012 |

(Continued)

*Primary Examiner* — Benny T Lee

(57) ABSTRACT

A cavity device is disclosed comprising a plurality of flat boards stacked one on lop of the other to form a multilayered structure. At least some of the flat boards comprise at least one opening or perforations having one or more layers of electrically conducting materials configured to establish electrical conduction with one or more layers of electrically conducting materials of another one of the flat boards, to thereby form electrically conducting patterns in the multilayered structure for interacting with electromagnetic radiation introduced into the cavity device.

10 Claims, 17 Drawing Sheets

(56) References Cited

U.S. PATENT DOCUMENTS

| | | | |
|---|---|---|---|
| 2015/0381229 | A1 | 12/2015 | Tzanidis et al. |
| 2018/0145385 | A1 | 5/2018 | Howard et al. |

FOREIGN PATENT DOCUMENTS

| | | | |
|---|---|---|---|
| CN | 103855454 | A | 6/2014 |
| CN | 104332413 | A | 2/2015 |
| CN | 06252804 | A | 12/2016 |
| CN | 106252804 | A | 12/2016 |
| CN | 206564313 | U | 10/2017 |
| KR | 20040092127 | A | 11/2004 |
| WO | 2007149046 | A1 | 12/2007 |
| WO | 2013027057 | A1 | 2/2013 |

* cited by examiner

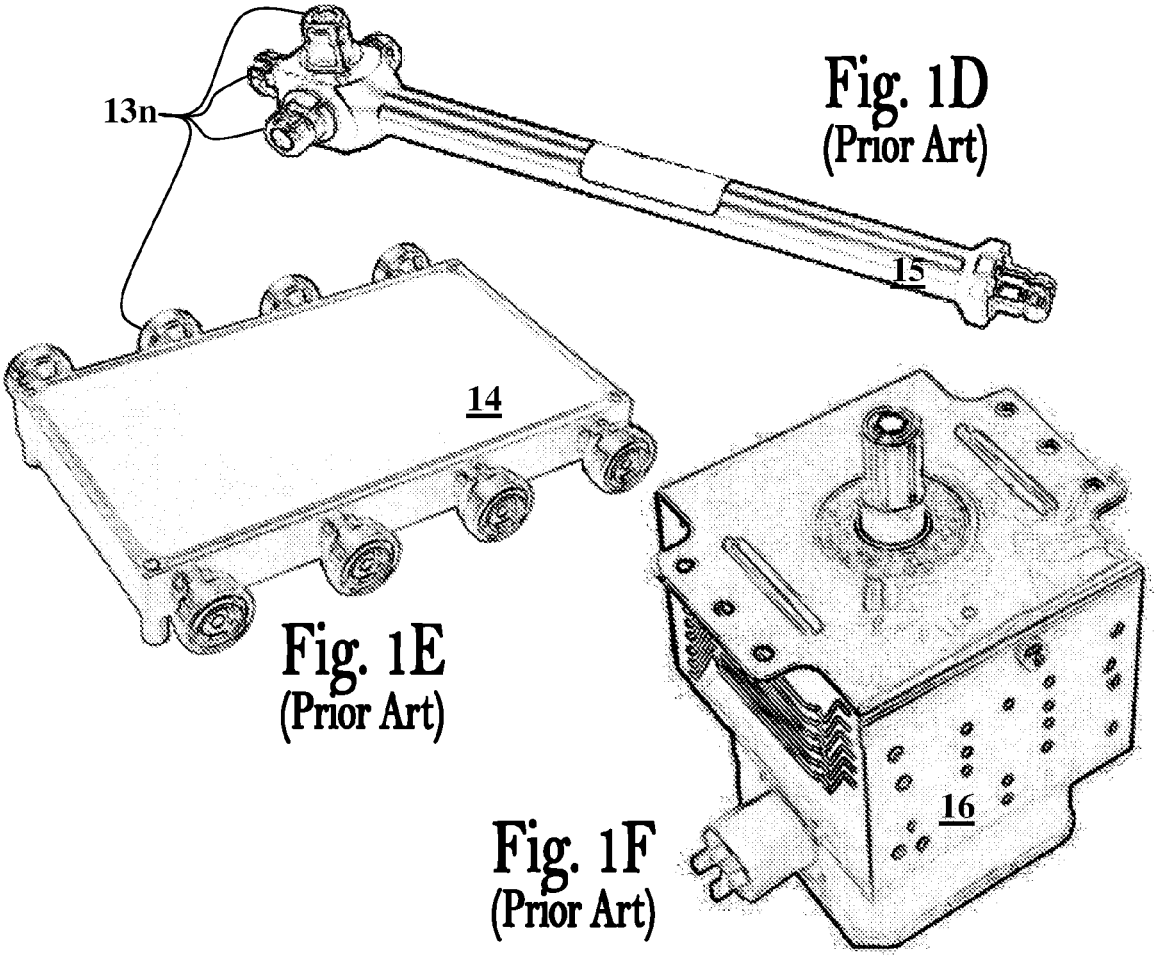
Fig. 1D
(Prior Art)
Fig. 1E
(Prior Art)
Fig. 1F
(Prior Art)
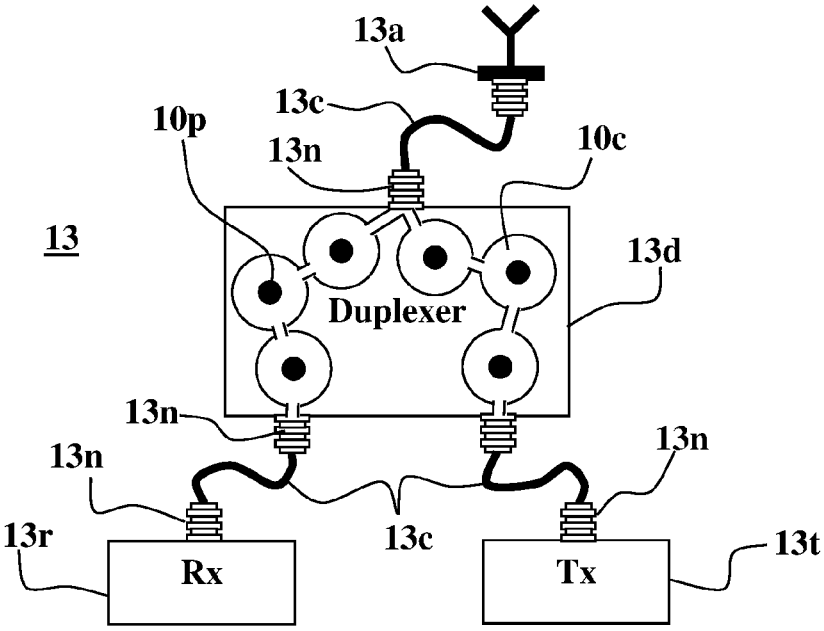
Fig. 1G
(Prior Art)

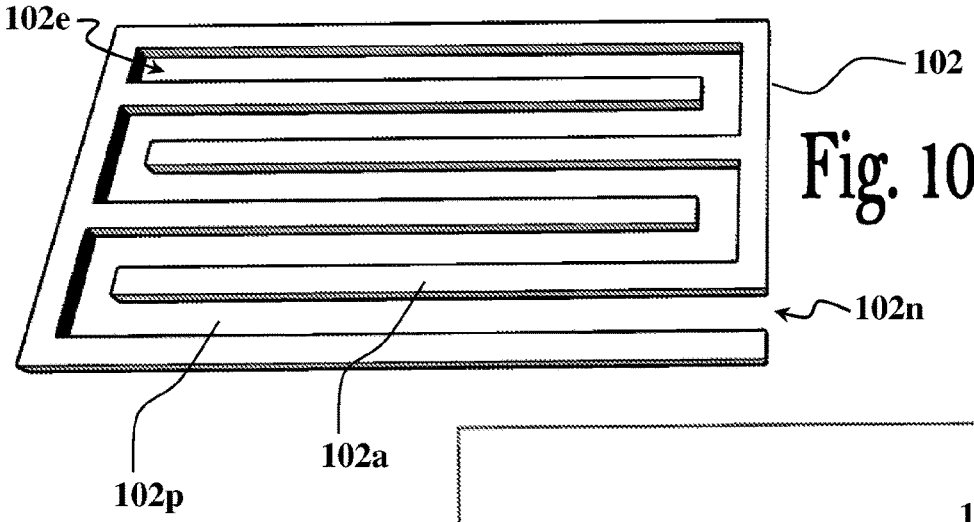
Fig. 10B
Fig. 10A
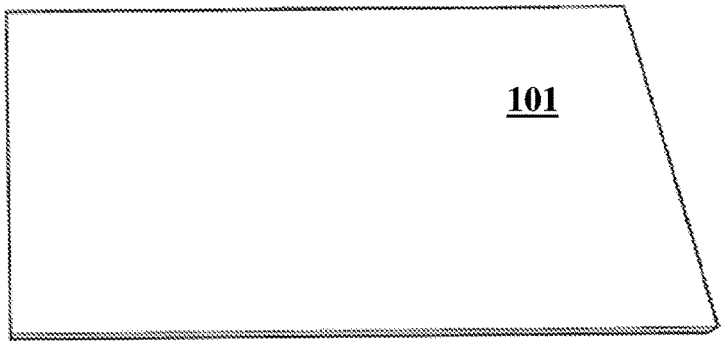
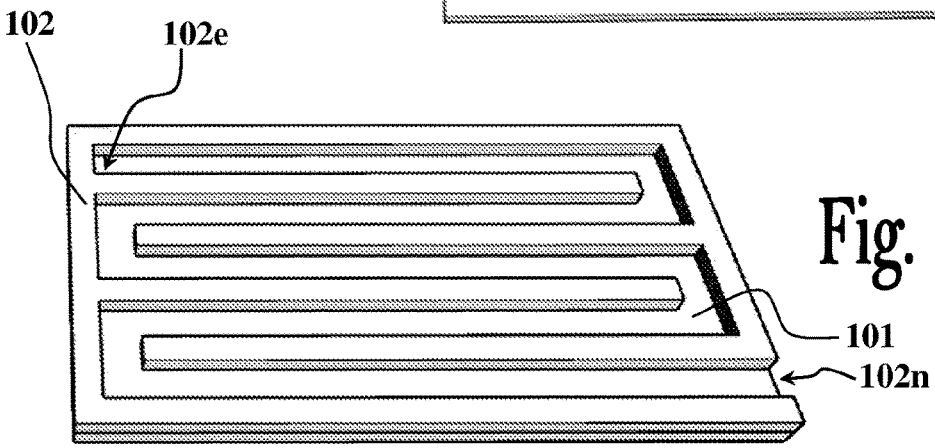
Fig. 10C
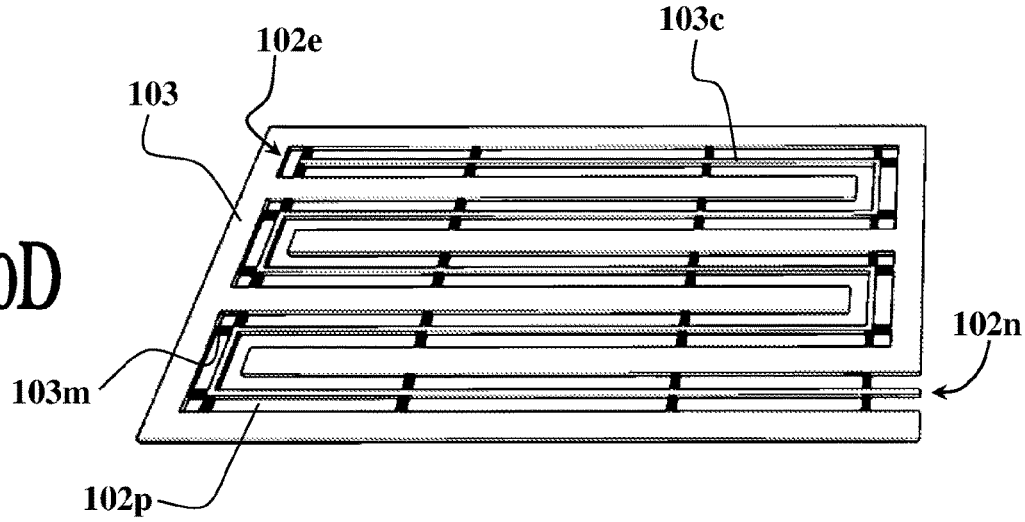
Fig. 10D

METHOD OF CONSTRUCTING A CAVITY COMPRISING FORMING ONE OR MORE CONDUCTIVELY COATED OPENINGS IN A PLURALITY OF BOARDS AND PLACING A ROD OR TUNING POST THEREIN

TECHNOLOGICAL FIELD

The present invention generally relates to cavity resonators, and other types of cavity structures, such as used in radiofrequency (RF) and micro-wave applications, and to systems utilizing such resonant/structures cavities.

BACKGROUND

Cavity resonators are typically closed electrically conducting structures (e.g., metal box) that reinforce standing-wave in the cavity filled with air/gas, or another dielectric/diamagnetic material, and configured to trap electromagnetic waves thereinside. Radio frequency and microwave cavity resonators are specifically designed to confine electromagnetic fields in the radiofrequency and microwave ranges of the spectrum, respectively. These cavity resonators can be used as filters, duplexers, diplexers with known topologies such as combline, interdigital, dielectric resonance, waveguide structures, tubular, coaxial resonator cavity and more. Other types of cavity structures can be used to implement coaxial cables, wave guides, splitters, combiners, circulators, isolators, couplers, hybrids couplers, delay line, magnetrons, and suchlike.

Most of the RF/microwave resonant cavities, and other such cavity structures, are made nowadays from an electrically conducting metal material(s), such as aluminum, brass, copper, stainless steel, and the like. Usually, the inner surfaces of the resonant cavities and cavity structures are coated with good electrically conducting plating such as, but not limited to, silver, gold, copper, and the like. Thus, the fabrication of such cavity structures typically involves machining of a metal block, e.g., milling and/or drilling of an aluminum block, or deformation of metal sheets, and usually also involves plating surfaces of the structure with materials having high electrical conductivity, to increase reflectivity, hence, reduce losses of the electromagnetic waves.

These manufacture techniques of the resonant cavities thus yield a product which is substantially heavy, expensive, bulky, and of relatively great geometrical dimensions and volume. RF and microwave resonant cavities typically include external connectors configured to couple the resonant cavities to other system components (e.g., transceivers, signal generators, amplifiers, low noise amplifiers, and the like). The introduction of such connectors in the resonant cavities, and also in other types of cavity structures, typically cause RF performances degradation. In addition, the manufacture of the cavity structures in the conventional techniques involve a waste of natural metal resources during the process, is not environmental effective/friendly, and is only suitable to limited types and designs of cavity resonators.

US Patent Publication No. 2015/0381229 describes a transmitter that includes apparatus for integrating the antenna feed into a multilayer PCB. The apparatus includes an antenna element disposed over the multilayer PCB having slot openings that substantially overlap and that enable an RF signal to be coupled from a printed transmission line located on one of the multilayer PCB conductive layers. The multilayer PCB board hosts at least one transceiver unit and a baseband unit such that the antenna feed, transceiver and baseband units are integrated on a single multilayer PCB board without degradation of antenna bandwidth and efficiency.

US Patent Publication No. 2014/0145883 describes a package structure that includes a planar core structure, an antenna structure disposed on one side of the planar core structure, and an interface structure disposed on an opposite side of the planar core structure. The antenna structure and interface structure are each formed of a plurality of laminated layers, each laminated layer having a patterned conductive layer formed on an insulating layer. The antenna structure includes a planar antenna formed on one or more patterned conductive layers of the laminated layers. The interface structure includes a power plane, a ground plane, signal lines, and contact pads formed on one or more patterned conductive layers of the laminated layers of the interface structure. The package structure further includes an antenna feed line structure formed in, and routed through, the interface structure and the planar core structure, and connected to the planar antenna.

Korean Patent Publication No. KR20040092127 describes a mobile terminal having multiple matching circuits capable of effectively matching impedance of an antenna and a duplexer in a small space by designing matching circuits in a multi-layer structure. A duplexer unit separates an RF signal transmitted/received by an antenna unit. A matching circuit unit is constructed as a multi-layer PCB (Printed Circuit Board) to match different impedances according to an operation mode or a usage band of a mobile terminal. A switching unit selectively connects one of the plurality of matching circuits to the antenna unit or the duplexer unit. A controller controls the switching unit according to the operation mode or the usage band of the terminal.

US Patent Publication No. 2012/0242425 describes fabrication method and structure for reducing structural weight in radio frequency cavity filters and novel filter structure. The novel filter structure is fabricated by electroplating the required structure over a mold. The electrodeposited composite layer may be formed by several layers of metal or metal alloys with compensating thermal expansion coefficients. The first or the top layer is a high conductivity material or compound such as silver having a thickness of several times the skin-depth at the intended frequency of operation. The top layer provides the vital low loss performance and high Q-factor required for such filter structures while the subsequent compound layers provide the mechanical strength.

SUMMARY OF THE INVENTION

The present application generally provides multilayered cavity structures, usable for implementing cavity resonators and other (electromagnetic/RF) cavity structures, and methods of manufacture thereof. The disclosed cavity structures are particularly useful for radiofrequency and microwave cavities, and also for other applications requiring trapping, and/or filtering, and/or manipulating, and/or guiding, of electromagnetic waves. The cavity structures according to some possible embodiments are constructed from a plurality of flat boards. At least some of the flat boards are optionally made from dielectric and/or diamagnetic materials. At least some of which the flat boards have at least one opening formed therein. Optionally, some, or all, of the plurality flat boards are made from an electrically conducting material. One or more electrically conducting material layers are applied at least over the edges of the opening in the flat boards having the at least one opening, and in some embodiments also over surface areas of the flat boards surrounding/about their openings. At least one surface area of the flat boards not having an opening therein is covered by one or more electrically conducting material layers.

The plurality of flat boards are stacked one on top of the other to form a multilayered structure having one or more channels constructed by the openings formed in at least some of the flat boards, such that continuous electrical conductivity is obtained along each channel by the conducting material layers applied on and/or about the openings. The topmost and bottommost hoards, and in some embodiment also one or more intermediate boards, in the multilayered structure are flat boards (e.g., made of PCB, or electrically conducting or non-conducting material) not having an opening, configured to cover openings of the channels formed in the structure by the at least one surface area covered by the one or more electrically conducting material layers, to thereby form in the multilayered structure one or more internal hollow cavities with surfaces that are covered by the one or more electrically conducting layers.

In this way, lightweight and relatively small sized resonant cavities can be easily constructed. It is noted that the openings formed in at least some of the flat boards can be configured such that the one or more channels formed in the multilayered structure extends in sideway and/or diagonal transverse directions, relative to the planes of the flat boards, which greatly enhance flexibility and compactness of the design, particularly compared to the conventional manufacture techniques that require milling/drilling the cavities in a piece of material i.e., the conventional manufacture techniques permit forming the cavity in only one specific direction.

One or more bores can be drilled, or integrally formed during the regular board manufacturing process, in the multilayered cavity structure for introducing and/or outputting electromagnetic radiation. Any suitable connector can be attached to the drilled/formed bores for connecting the multilayered cavity structure to electromagnetic signal source circuitries (e.g., transmitters, antennas) and/or electromagnetic signal recipient circuitries (e.g., receivers, antennas). In some embodiments one or more of the electromagnetic signal sources and/or recipients circuitries are mounted over one of the flat boards of the multilayered cavity structure. In such embodiments the attachment of connectors to at least some of the drilled bores (or formed by the structural design of the boards) can be avoided by directly coupling the one or more electromagnetic signal sources and/or recipients circuitries mounted on one of the multilayered resonator structures to respective ones of the drilled bores.

Optionally, but in some embodiments preferably, at least some of the flat boards are made from circuit boards (e.g., printed circuit boards—PCB). Implementing the layers by printed circuit boards is particular advantageous in applications requiring mounting the electromagnetic signal sources and/or recipients circuitries directly to one of the layers of the multilayered resonant cavity structure.

In some embodiments instead of forming at least one opening in some of the flat boards, a set of vias, coated by an electrically conducing material, are formed along a closed loop in a shape of the opening, in at least some of the flat boards. The vias made in at least some of the flat boards can be aligned such that when the at least some of the flat boards are stacked one on top of the other continuous electrical conductivity is obtained by the electrical conducing material filling and/or coating the vias. Optionally, and in some embodiments preferably, one or more regions of the one or more of the flat boards are covered by one or more layers of electrically conducting material electrically connected to the material filling/coating the vias, for forming a cover entirely, or partially, closing non-hollow cavities formed in the multilayered structure. Such flat boards having both the vias and the one or more regions with the electrically conducting material can be used as a topmost, bottommost, or an intermediate, in the multilayered structure.

Additionally, or alternatively, the topmost and the bottommost flat boards, and in some embodiment also one or more intermediate flat boards, do not include vias, but have one or more electrically conducting material layers applied to at least one surface area thereof, configured to establishing electrical connection with the electrically conducting material filling and/or coating the vias, to thereby form a non-hollow cavity structure. Sizes/diameters of the vias in some embodiments are made substantially small, in a manner that substantially prevents passage of electromagnetic radiation through the non-hollow cavity structure.

The vias are formed in the at least some of the flat boards in very small distances one from the other (e.g., about 0.1 to 2 mm), and are of very small diameter (e.g., about 0.01 millimeters to few centimeters), to guarantee reflection of the electromagnetic radiation introduced into the multilayered cavity structure. This way multilayered (resonating) cavity structures filled by the material of the flat boards can be formed, without forming the openings in some, or all, of the flat boards forming the cavity structures. Such embodiments, wherein the resonant cavity is filled by the dielectric/diamagnetic material of the flat boards, permits substantial reduction in the geometrical dimension of the resonating cavities.

For example, and without being limiting, using at least one board with good dissipation factor of the dielectric material of the board, such as, but not limited to, materials available from Rogers Corporation, 2225 W. Chandler Blvd. Chandler, AZ 85224 Phone: 480.917.6000 877.643.7701 Fax: 480.857.2819, may create, with this technique, a non-hollow cavity structure that is loaded with dielectric material of the board. This cavity structure, that is usable for cavity dielectric resonance or cavity dielectric filter, is advantageous due the smaller geometrical dimensions of the non-hollow cavity structure compared to a hollow cavity structure, due to the fact that the electromagnetic field propagates inside a dielectric material substantially slower than in the air (or vacuum).

In addition, such embodiments, wherein the cavity structure is partially, or entirely, filled by the dielectric material can reduce production cost. For example, by using the dielectric board material as a connected arm into additional conductive part inside the cavity structure, creates a conductive structure inside the hollowed cavity structure, such as, for example, a rod typically used inside a combline cavity filter. Such usage of the dielectric material of the boards to guide electromagnetic radiation may preclude the need to mechanically add this rod after milling the cavity structure, and thereby contributes to reducing material and workmanship costs.

The coating of the edges and/or surrounding surfaces of the openings, and/or of the at least one surface area of the flat boards not having the openings, and/or formation of the vias and filling and/or coating the vias with electrically conducting material, can be carried out using techniques well known in the printing circuits industry.

It will be understood that when an element is referred to as being "connected to" another element, it can be directly connected to the other element or intervening elements may also be present. In contrast, when an element is referred to as being "directly connected to" another element, no intervening elements are present. Unless otherwise defined, all terms used herein, including technical or scientific terms, have the same meanings as those generally understood by those with ordinary knowledge in the field of art to which the present invention belongs.

One inventive aspect of the disclosed subject matter relates to a cavity resonator device comprising a plurality of flat boards stacked one on top of the other to form a multilayered structure, wherein at least some of the flat hoards comprising at least one opening or perforations having one or more layers of electrically conducting materials configured to establish electrical conduction with one or more layers of electrically conducting materials of at another one of the flat boards, to thereby form electrically conducting patterns in the multilayered structure for interacting with electromagnetic radiation introduced into the cavity device. The one or more layers of electrically conducting materials can be applied on and about the at least one opening in the at least some of the flat boards.

In some embodiments the at least one opening in the at least some of the plurality of flat boards is configured to form at least one cavity in the multilayered structure filled by one or more gaseous materials or in vacuum conditions. The two or more of the plurality of flat boards can comprise one or more layers of electrical conducting materials applied over at least one surface area thereof and configured to establish electrical conduction with the electrically conducting patterns and cover the at least one cavity. Optionally, the cavity resonator device comprises at least one rod or tuning post attached to at least one of the flat boards.

Optionally, but in some embodiments preferably, the perforations in the at least some of the plurality of flat boards configured to form at least one non-hollow cavity in the multilayered structure that is filled with the material of the at least some of the plurality of flat boards. The perforations in the at least some of the plurality of flat boards can be configured to form at least one rod or tuning post in the at least one cavity.

At least one of a topmost and a bottommost flat board of the multilayered structure is made in some embodiments from an electrically conducting material. Optionally, at least one intermediate flat board of the multilayered structure is made from an electrically conducting material. In some possible embodiments at least some of the flat boards are made from printed circuit boards. In possible applications one or more passive or active circuitry components are mounted on at least one of the flat boards. The passive or active circuitry components can be electromagnetically coupled to at least one cavity of the device. The one or more passive or active circuitry components can comprise at least one power amplifier e.g., directly coupled to the cavity of the device. Additionally. or alternatively, the one or more passive or active circuitry components comprises at least one power splitter or combiner e.g., directly coupled to the cavity of the device.

Another inventive aspect of the disclosed subject matter relates to a method of constructing a cavity. The method comprises preparing a plurality of flat boards, at least some of the flat boards comprising one or more openings having edges coated by one or more layers of electrically conducing material, or having a plurality of perforations having one or more layers of electrically conducting materials, stacking the plurality of flat boards one on top of the other such that continuous electrical conduction in achieved between the one or more layers of electrically conducing material, thereby forming a multilayered structures having at least one hollow, or non-hollow, cavity formed therein. The method can comprise providing in the multilayered structure flat boards having one or more surface areas covered by one or more electrically conducting material layers configured to entirely, or partially, cover the at least one cavity.

The method comprises, in some embodiments, placing at least one rod or tuning post in the at least one cavity. Optionally, some of the perforations in the at least some of the plurality of flat boards configured to form at least one rod or tuning post in the at least one cavity.

In some embodiments at least one topmost or bottommost flat board of the multilayered structure is made from an electrically conducting material. Optionally, at least one intermediate flat board of the multilayered structure is made from an electrically conducting material. The method can comprise fabricating at least some of the flat boards from printed circuit boards.

In some possible embodiments the method of comprises attaching one or more passive or active circuitry components to at least one of the flat boards. The one or more circuitry components can be then electromagnetically coupled to the at least one cavity.

BRIEF DESCRIPTION OF THE DRAWINGS

In order to understand the invention and to see how the invention may be carried out in practice, embodiments will now be described, by way of non-limiting example only, with reference to the accompanying drawings. Features shown in the drawings are meant to be illustrative of only some embodiments of the invention, unless otherwise implicitly indicated. In the drawings like reference numerals are used to indicate corresponding parts throughout the detailed description of the drawings, and in which:

FIGS. 1A to 1G shows various conventional resonant cavity implementations, wherein FIG. 1A shows inner components of a resonant cavity, FIG. 1B shows external components of a resonating cavity usable as a duplexer, FIG. 1C shows inner and external components of another resonant cavity, FIG. 1D shows a four-way power splitter/divider, FIG. 1E shows a hybrid coupler, FIG. 1F shows a magnetron, and FIG. 1G schematically illustrates use of a RF-cavity duplexer in a radio system;

FIGS. 2A to 2G schematically illustrate construction of a multilayered resonant cavity structure according to some possible embodiments, wherein FIG. 2A shows flat boards used to construct the multilayered resonant cavity structure, FIG. 2B exemplify application of electrically conducting plating about an opening formed in a flat board, FIG. 2C shows stacking of the flat boards one on top of the other to form the multilayered structure, FIG. 2D shows a perspective view of the multilayered resonant cavity structure obtained, FIG. 2E shows the multilayered resonant cavity structure obtained after forming in it bores and attaching connector to them, and FIGS. 2F and 2G show sectional views of the multilayered resonant cavity structure;

FIGS. 4A and 4B schematically illustrate combining several components and circuitries of a RF system in a multilayered structure according to some possible embodiments, wherein FIG. 4A is a block diagram of the RF system and FIG. 4B shows structure and components of a flat board in the multilayered structure;

FIG. 5B shows a possible structure of a network of perforations;

FIGS. 6A to 6C schematically illustrate construction of a multilayered resonant cavity from flat boards having according to some possible embodiments openings for forming cavities of the apparatus and attachment arms configured to hold in each cavity a portion of a rod and/or tuning post, wherein FIG. 6A shows a flat board comprising the openings, attachment arms, and rod and/or tuning post portions, and FIGS. 6B and 6C exemplify use of metal filled/coated perforations for reflection of electromagnetic radiation from the sections of tuning post portions that connect to the attachment arms.

FIGS. 8A and 8B schematically illustrate construction of a corrugated circular waveguide according to some possible embodiments, wherein FIG. 8A shows a perspective view of the waveguide, and FIG. 8B shows a sectional view of the waveguide;

FIGS. 10A to 10I schematically illustrate construction of a rectangular coaxial delay line according to some possible embodiments;

DETAILED DESCRIPTION OF EMBODIMENTS

Figure 1A:
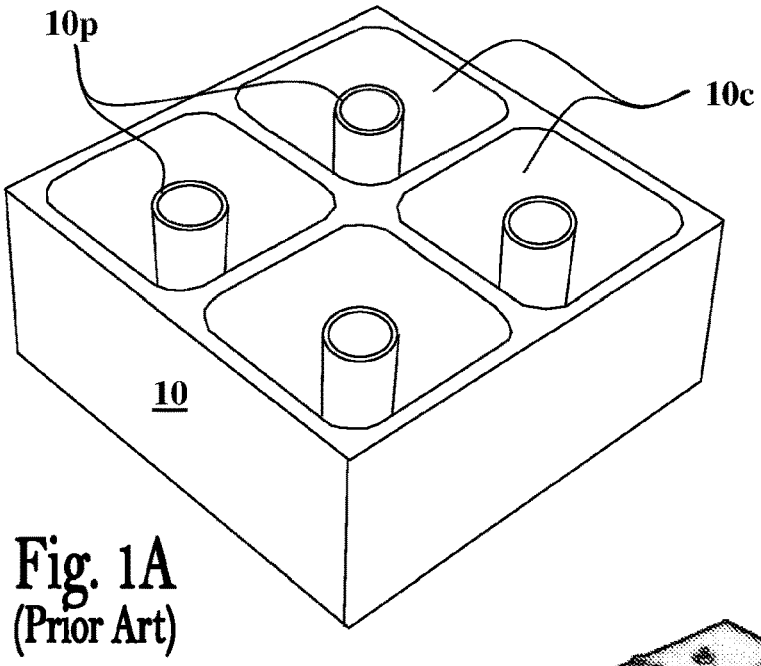
Fig. 1A (Prior Art)

One or more specific embodiments of the present disclosure will be described below with reference to the drawings, which are to be considered in all aspects as illustrative only and not restrictive in any manner. In an effort to provide a concise description of these embodiments, not all features of an actual implementation are described in the specification. Elements illustrated in the drawings are not necessarily to scale, or in correct proportional relationships, which are not critical. Emphasis instead being placed upon clearly illustrating the principles of the invention such that persons skilled in the art will be able to make and use the cavity structures, once they understand the principles of the subject matter disclosed herein. This invention may be provided in other specific forms and embodiments without departing from the essential characteristics described herein.

The present application is about construction of multilayered resonant cavities, and other multilayered (RF/electromagnetic radiation) cavity structures, all of which may be referred to herein as "multilayered cavity structures" or just as "cavity structures" for short. The multilayered cavity structures disclosed herein are designed to provide lightweight and cost-effective (resonators and/or RF) cavity structures, that can be efficiently and compactly integrated in RF and microwave systems. Multilayered cavity structures according to some possible embodiments are constructed by stacking a plurality of flat boards, some of the boards may be made from a dielectric/diamagnetic material (e.g., PCBs), one on top of the other to form one or more closed cavities by openings formed in at least some of the flat boards. Edges of, and/or surface areas about, the openings formed in at least some of the flat boards are coated by one or more layers of electrically conducting materials, such that when the flat boards are stacked one on top of the other continuous electrical conduction is obtained along the walls of formed the cavities. One or more surface areas of the flat boards closing the one or more cavities are also coated by one or more electrically conducting layers, such that continuous electrical conduction is obtained between the walls of the cavities and the surface areas closing the cavities. With all sides of the cavities coated by the one or more electrically conducting layers electromagnetic waves can be reflected from the walls of the cavities and trapped therein.

One or more cavities can be formed in some embodiments by vias filled/coated by electrically conducting materials. The vias are formed in some of the flat boards, instead of the one or more openings, and these vias are aligned such that when the flat boards are stacked one on top of the other continuous electrical conductions is obtained along the stacked flat boards. The spacing between the vias is made sufficiently small to guarantee reflection of electromagnetic waves. Optionally, and in some embodiments preferably, flat boards having one or more layers of electrically conducing material on at least one surface area thereof are placed over top and bottom sides of stacks of the flat boards with the vias, such that electrical conduction is obtained between the vias of the stacked flat boards and the one or more surface areas of the top and bottom flat boards. This way, cavity structures filled by the material of the flat boards can be obtained.

In some embodiments one or more rod and/or tuning posts, and/or any other electrically conducting structure, made from, and/or coated by one or more layers of, electrically conducting material, are placed, or formed inside at least one of the cavities. For example, and without being limiting, a tuning post can be attached to a topmost, or to a bottommost, flat board of a multilayered cavity structure. Alternatively, a tuning post can be formed in at least one of the cavities by vias filled and/or coated by electrically conducting material. A movable conductor plate electrically connected to a wall of one of the cavities can be placed at a defined distance above the tuning post, for adjusting electrical parameters of the one or more cavities. One or more holes can be drilled in the multilayered resonant structure for introducing electromagnetic radiation into the one or more cavities.

For an overview of several example features, process stages, and principles of the invention, the examples of multilayered cavity structures illustrated schematically and diagrammatically in the figures are intended for a RF and/or microwave applications. These multilayered cavity structures are shown as one possible example implementation that demonstrates a number of features, processes, and principles used to construct multilayered cavity structures, but these techniques are also useful for other applications and can be made in different variations. Therefore, this description will proceed with reference to the shown examples, but with the understanding that the invention recited in the claims below can also be implemented in myriad other ways, once the principles are understood from the descriptions, explanations, and drawings herein. All such variations, as well as any other modifications apparent to one of ordinary skill in the art and useful in RF/microwave applications may be suitably employed, and are intended to fall within the scope of this disclosure.

Figure 1B:
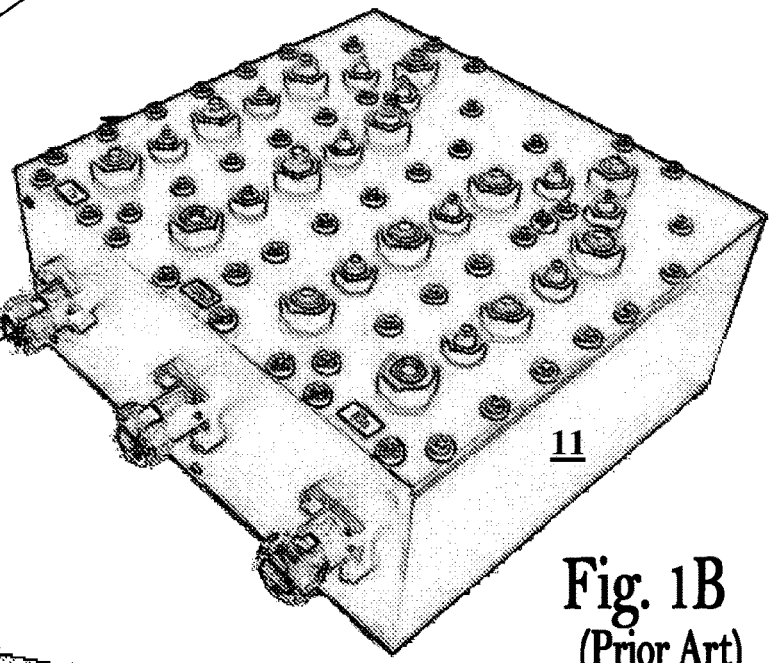
Fig. 1B (Prior Art)
Figure 1C:
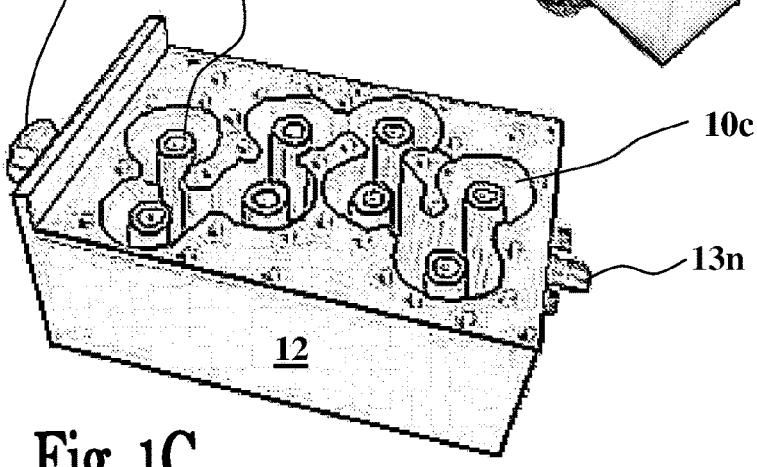
Fig. 1C (Prior Art)

FIG. 1A schematically illustrates a resonator configuration 10 comprising four RF cavities 10*c*, as conventionally made by milling/drilling or melting/molding a piece of electrically conductive metal (e.g., made of aluminum, brass, copper, or combination thereof). Each cavity can have an internal rod 10*p* attached to a bottom surface of the cavity. FIG. 1B shows external components of a resonating cavity 11 having three connectors 13*n*, usable as a duplexer. FIG. 1C shows inner and external components of another resonant cavity 12, wherein a plurality of connected cavities, each having an internal rod 10*p*, form a continuous resonator having a connector 13*n* at one side of the apparatus 12 for electromagnetic coupling one side of the continuous sequence of cavities, and a connector 13*n* at another side thereof for electromagnetic coupling the other side of the continuous sequence of cavities. FIG. 1D shows a four-way power splitter/divider 15, FIG. 1E shows a hybrid coupler 14, FIG. 1F shows a magnetron 16, and FIG. 1G schematically illustrates use of a RF-cavity duplexer 13 in a radio system.

These conventional apparatuses are usually manufactured by drilling/milling a cube of aluminum, for instance, to from the needed cavities 10*c*. In the final outcome of these production processes there is a lot of unused waste material. On the other hand, since the basic raw material is Aluminum, or another metal, the final product is considerably heavy e.g., for a cellular product about hundreds gram to thousand grams. In addition to the relative high weight of such conventional resonant cavities, such resonators are also relatively expensive, for at least the following reasons:

- the basic raw material used is typically bulk aluminum, or other metal, which is relatively expensive;
- the cutting out process (milling) is an expansive mechanical process;
- the coating technology for the metal after the milling process is also relatively expensive;
- from the system perspective: there is a requirement nowadays to separate the RF cavity components from other active components, as the cavity components are manufactured using technologies different from the technologies used for the other active components, or to integrate the cavity components and the active components together.

Employing embodiments disclosed herein provides that the process is identical for all the components (e.g., based on PCB structure), such that there is no need to separate between the cavity components and the other active components, and/or such that all the components can be manufactured by the same production process.

By using the multilayered cavity structures disclosed herein the price of RF/microwave systems can be substantially reduced due to the fact that the same manufacturing process is used, which may further exclude the need for connecting cables between the cavity components and/or the other components (e.g., see, FIG. 1G), and that there is no need for the mechanical assembly phase between the cavity components and the other components, since the cavity structure is manufactured with the other components of the system being interconnected during the PCB fabrication stage, such that there is no need to connect the system components by cables, as conventionally performed. Furthermore, the manufacturing, and the testing, of the multilayered cavity structures disclosed herein can be made on much bigger system chain i.e., in one continuous manufacture chain.

In addition, the dielectric material filling the cavities of the multilayered structure determines the electromagnetic field wave propagation velocity, and hence defines the volume/size of the cavity. Usually, the material within these RF cavity components is air, as shown in FIGS. 1A, 1C and 1G. By using a different material, such as the FR-4, or other material which is the basic raw material of the PCB, a substantial reduction in the wave propagation velocity can be achieved due to the increase in the dielectric coefficient, which permits substantial reduction of the volume of the cavity. Additional, and/or a different, volume/size reduction can be achieved by using a jagged cavity structure that enable achieving the same Q factor (e.g., as shown in FIGS. 12E and 12F)—to thereby provide same insertion loss with a smaller resonator size. Additional, and/or a different, system volume/size reduction can be achieved by integrating the multilayered cavity structure with other system components in the PCB level.

FIG. 1G is a block diagram of a system 13 utilizing a duplexer 13*d* to receive in a receiver (Rx) 13*r*, and transmit by a transmitter (Tx) 13*t*, signals via an antenna 13*a*. Due to the requirement to separate the resonant cavities from the other active components in system 13 (since the resonant cavities and the other components are manufactured in different technologies), the components of the system 13 are connected to the resonant cavities of the duplexer 13*d* by means of connectors 13*n* and cables 13*c*, which contribute losses at the most critical parts involved in transmitting and receiving electromagnetic signals. Reducing these losses by manufacturing most of the components with the same technology can be used to transmit greater powers, and to receive lower signal powers, using the same system components.

In RF systems e.g., 13 shown in FIG. 1G, the resonant cavity components are ones of the heaviest components. Such systems may be, for example, base stations, repeaters, distributed antenna system (DAS) components, remote radio head/Unit (RRH/RRU), RF front head, RADAR head, or the like. The construction of such systems utilizing the multilayered cavity structures disclosed herein can reduce transportation efforts, since the system obtained this way is substantially lighter.

As will be apparent from the following description, the multilayered cavity structures disclosed herein permit construction of cavities in various different orientations (e.g., transverse and/or diagonal relative to the planes of the flat boards) within the multilayered structure. This provides a significant improvement over the conventional milling/drilling manufacture techniques, which permits formation of cavities in limited directions, and opens new designs possibilities for cavity structures, for example, using previously unused parts of the volume of the cavity, reducing a volume of a cavity, and many other possibilities. By using such designs, for instance, the integration of cavity duplexer (e.g., 11 in FIG. 1B or 13*d* in FIG. 1G implemented by multilayered resonator structures descried herein) and a power splitter (e.g., 15 in FIG. 1D implemented by multilayered cavity structures descried herein), can be integrated together in the same multilayered structure.

FIGS. 2A to 2G schematically illustrate construction of a multilayered resonant cavity 20 of a duplexer. It is understood that the disclosed technique is not limited to cavity duplexers, and that the technique can be similarly used for manufacturing other types of resonant cavities or RF structures, mutatis mutandis. The multilayered resonator duplexer 20 is designed to operate with two different frequencies, and hence the structure of the resonant cavity 20 comprises two connected volumes, 20*a* and 20*b* (high and low frequency volumes). It is also noted that the inner structures of the resonant cavity 20 can assume any suitable shapes, and that the suitable shapes are not limited to the rectangular configuration exemplified in FIGS. 2A to 2G.

Figure 2A:
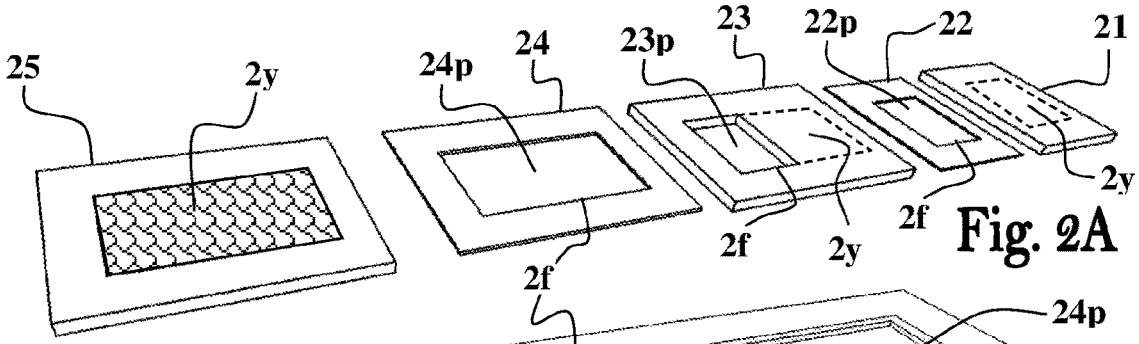

FIG. 2A shows various embodiments of flat boards used to construct the resonant cavity 20. Optionally, resonant cavity comprising a first cover 21, one or more first apertured boards (for example, first apertured boards 22), an intermediate boards (for example, intermediate board 23), one or more second apertured boards (for example, second apertured board 24), and a second cover 25. The first and second covers, 21 and 25, each comprises at least one surface area covered by one or more layers of electrically conducting materials 2*y*. The first apertured board 22 and second apertured boards, each comprises at least one opening (for example, opening 22*p* and opening 24*p*), and the intermediate board 23 comprises at least one opening 23*p*. Opening 23*p* is configured to connect between the two volumes, 20*a* and 20*b*, of the resonator 20.

Figure 2B:
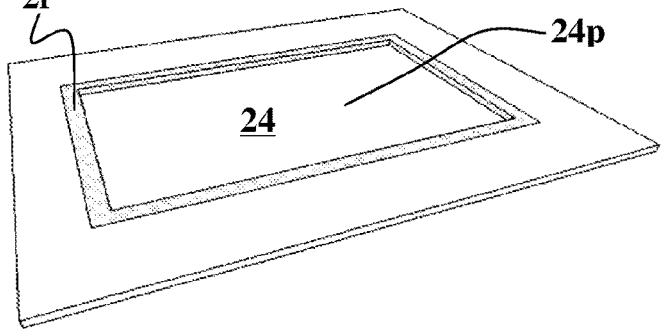

As best seen in FIG. 2B, Each of the openings, 22*p*, 24*p*, and 23*p*, comprises one or more layers of electrically conducting materials 2*f* applied on and/or about the opening (i.e., on the face of the edge/side of the opening and/or over at least a small portion/strip on the upper and bottom sides of the flat board) and configured to establish electrical conduction when stacked on top of the other hoards. As shown, in order to guarantee that electrical conduction is established between the electrically conducting layers of the openings, 22*p*, 24*p*, and 23*p*, the one or more electrically conducting layers can be applied over surface areas surrounding the openings.

Referring back to FIG. 2A, the first and second covers, 21 and 25, and the intermediate board 23, each comprises one or more layers of electrically conducting materials 2*y* applied over a surface area, the materials 2*y* configured to cover an opening 22*p*, 24*p* of an apertured board 22, 24 attached thereto and establish electrical connection with the one or more layers of electrically conducting materials applied on and/or about the edges of the opening 22*p*, 24*p*. More particularly, the electrically conducting surface 2*y* formed on the first cover 21 is configured to cover the opening 22*p* of a first apertured board 22 attached thereto, and establish electrical connection with the electrically conducting layers 2*f* applied on and/or about its opening 22*p*, and the electrically conducting surface 2*y* formed on the second cover 25 is configured to cover the opening 24*p* of a second apertured board 24 attached thereto, and establish electrical connection with the electrically conducting layers 2*f* applied on and/or about its opening 24*p*. On the other hand, the electrically conducting surface 2*y* in the intermediate board 23 is configured to only partially cover the opening 24*p* cavity, and thereby communicate between the volumes, 20*a* and 20*b* of the resonator 20. At least some of the flat boards 21, 22, 23, 24, and 25, can be implemented by printed circuit boards (PCBs), and the openings 22*p*, 23*p*, and 24*p*, and the one or more layers of electrically conducting materials applied on edges and/or about these openings, can be formed utilizing techniques well known in the PCB industry (surface coating and/or exposing and edge coating).

Figure 2C:
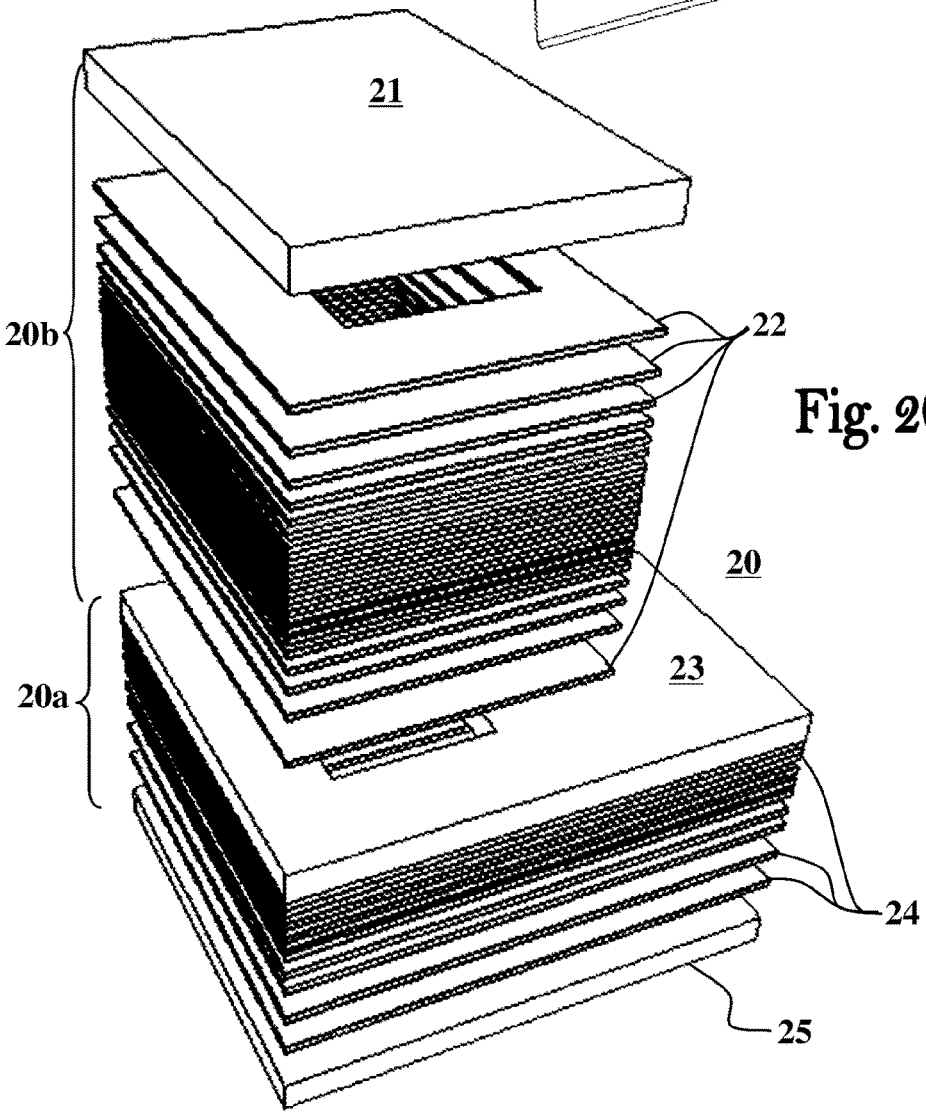

FIG. 2C shows construction of the resonant cavity 20 by the flat boards. In this specific and non-limiting example, nine apertured boards 24 are stacked one on top of the other on top of the second cover 25, to thereby define the volume 20*a*, a single intermediate board 23 is placed on top of the nine apertured boards 24 to partially cover an opening 24*p* of an apertured board 24 and attached thereto. Nineteen apertured boards 22 are stacked one on top of the other on top of the intermediate board 23, and the first cover 21 is placed on top of the nineteen apertured boards 22 to cover an opening 22*p* of a top apertured board 22 attached thereto, to thereby define the volume 20*b*. Accordingly, the high and low volumes, 20*b* and 20*a*, are defined by the shape and geometrical dimensions of the openings, 22*p* and 24*p*, and the number of first and second layers.

In some embodiments the first cover 21, and/or the second cover 25, and/or an intermediate boards 23, is made from Aluminum/magnesium, or suchlike material. Optionally, but in some embodiments preferably, the surface area 2*y* of the covers, 21 and 25, are plated by one or more silver layers.

Figure 2D:
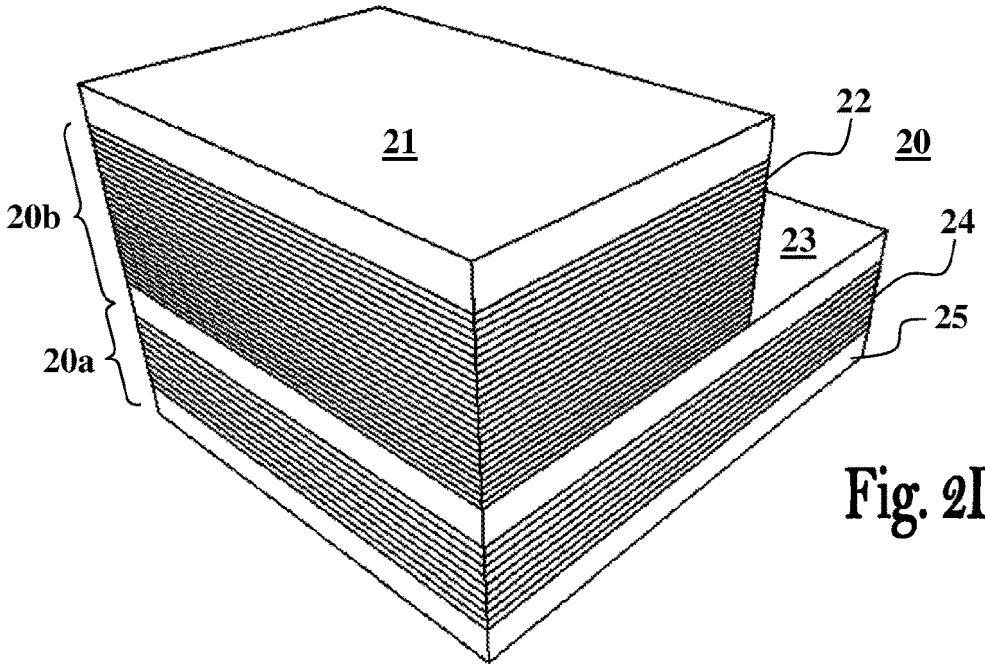

FIG. 2D shows a perspective view of the stacked multilayered resonant cavity structure 20 after the flat boards are attached one to the other. The flat boards of the multilayered stacked structure 20 can be attached one to the other by mechanical rods and/or screws (not shown) that connect and hold all of the flat boards together, and/or by one or more adhesive layers, and/or utilizing a thermal process in which a coated layer (e.g., a layer of tin and/or another coated layer) is melted to create a mechanical connection between the boards e.g., using a PCB to PCB board welding technique, such as reflow soldering, or wave soldering, or oven soldering, and/or other conductive connections, such us conductive glue or other. The boards attachment process comprises in some embodiments application of force and pressing (as used in multilayer PCB manufacture processes).

Figure 2E:
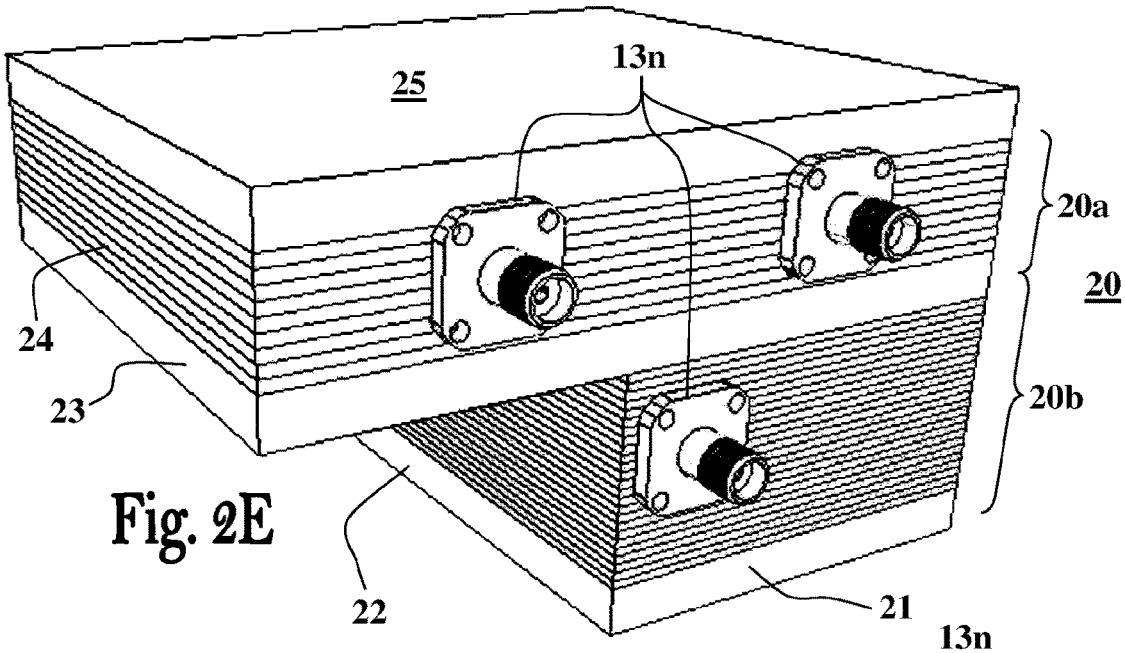
Figure 2F:
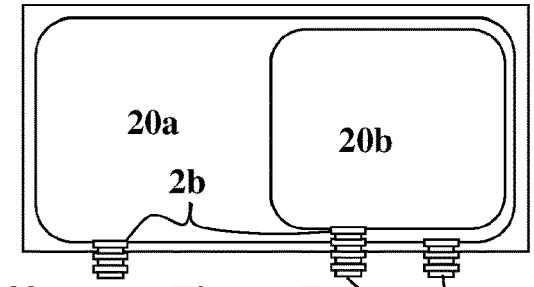
Figure 2G:
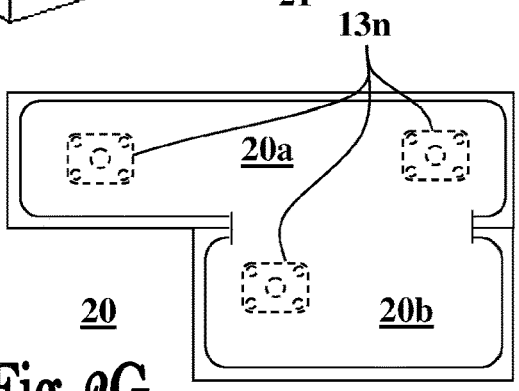

After the flat boards are attached one to the other, one or more holes 2*b* (shown in FIG. 2F) can be formed in walls, if not prepared during the PCB design process, of the multilayered resonator structure 20, for introducing electromagnetic waves thereinto. As seen in FIG. 2E, connectors 13*n* can be connected to the formed holes for connecting cables to the multilayered resonant cavity structure 20. In this specific and non-limiting example, the resonant cavity is a multiport apparatus, having three ports for implementing a resonant cavity duplexer, comprising the connected volumes 20*a* and 20*b*.

Figure 3A:
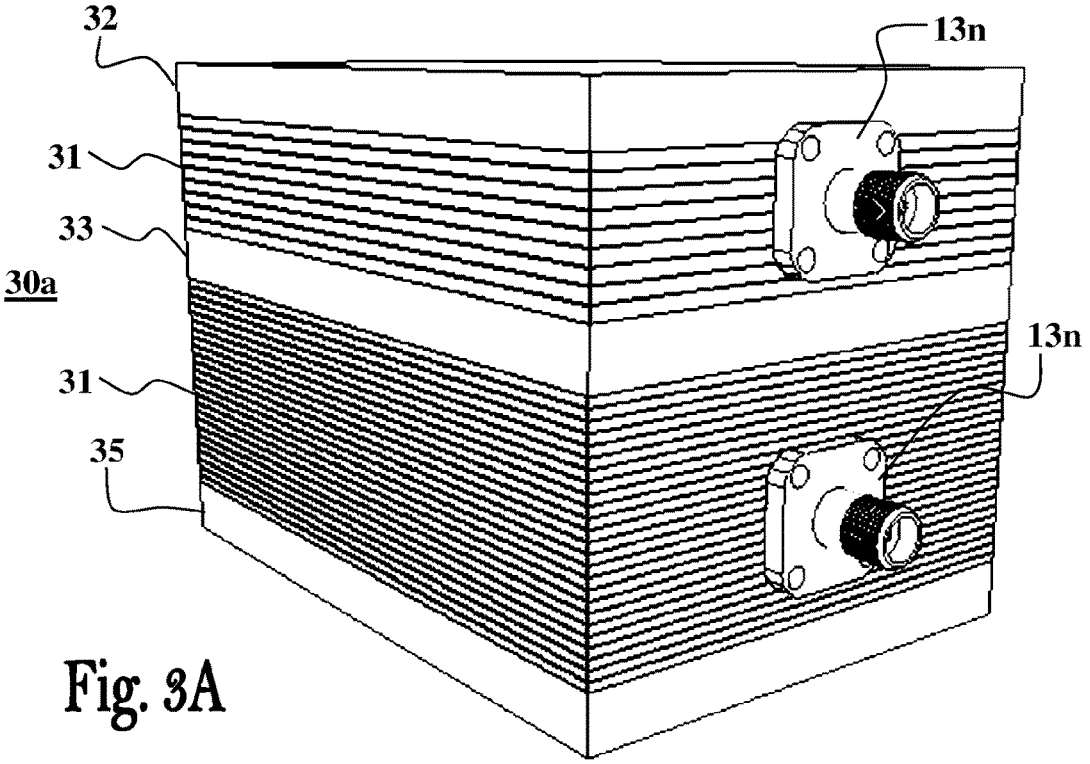
FIGS. 3A and 3B schematically illustrate dual port resonance cavity structures according to some possible embodiments.
Figure 3B:
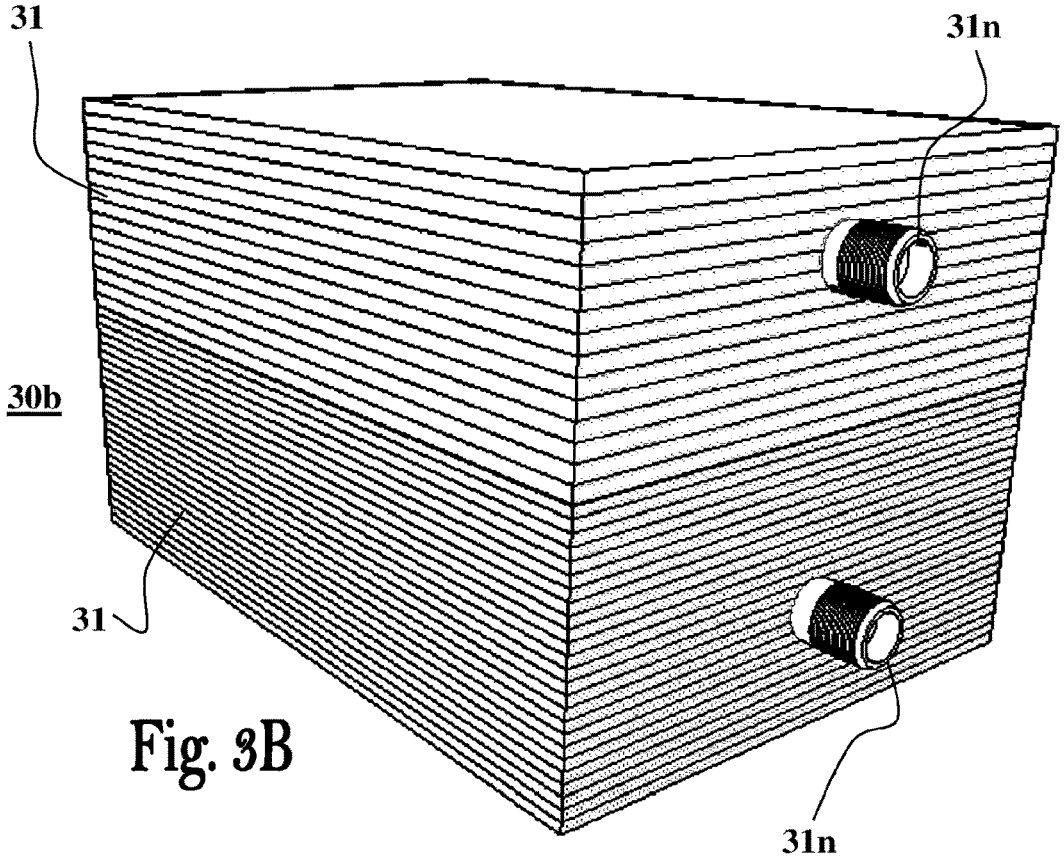

FIG. 3A exemplifies constructions of a dual port resonant cavity filter 30*a* using PCBs to implement the apertured flat boards 31, and metallic (e.g., made of Aluminum) boards to implement upper and bottom covers, 32 and 35, and an apertured intermediating board 33. In a similar fashion a single port RF component containing a cavity (e.g., a magnetron—not shown) can be implemented, or any other multiport multilayered cavity structure. FIG. 3B exemplifies constructions of a dual port resonant cavity 30*b* using only PCBs to implement the flat boards 31. As illustrated in FIG. 3A, the first (35) and the last (32) PCB layers of the device shown in FIG. 3B 3A are not apertured/hollowed, as the other layers (e.g., layers 31/33 illustrated in FIG. 3A). The connectors 31*n*, in this specific and non-limiting example, are integrated in a different phase of the manufacturing process, and not necessarily after the flat boards of the multilayered cavity resonator 30*b* are connected one to the other. For instance, the connectors 31*n* can be integrated in between the connection of several PCBs boards 31.

Figure 4A:
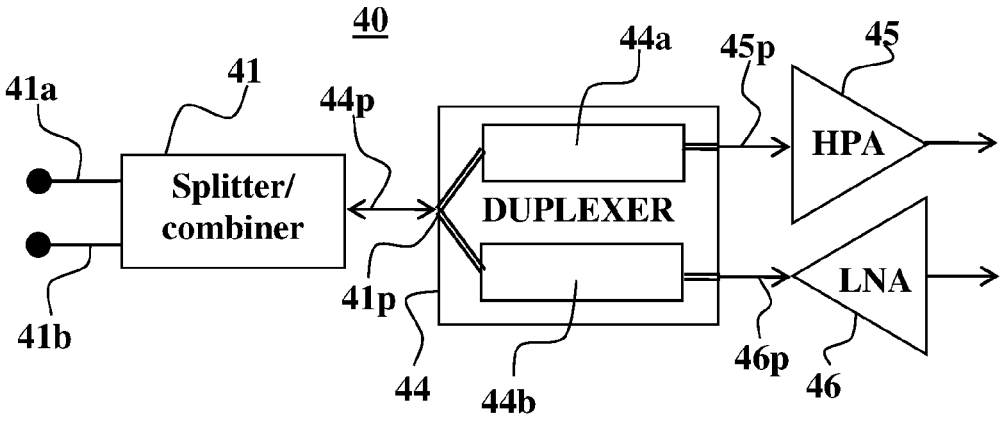
Figure 4B:
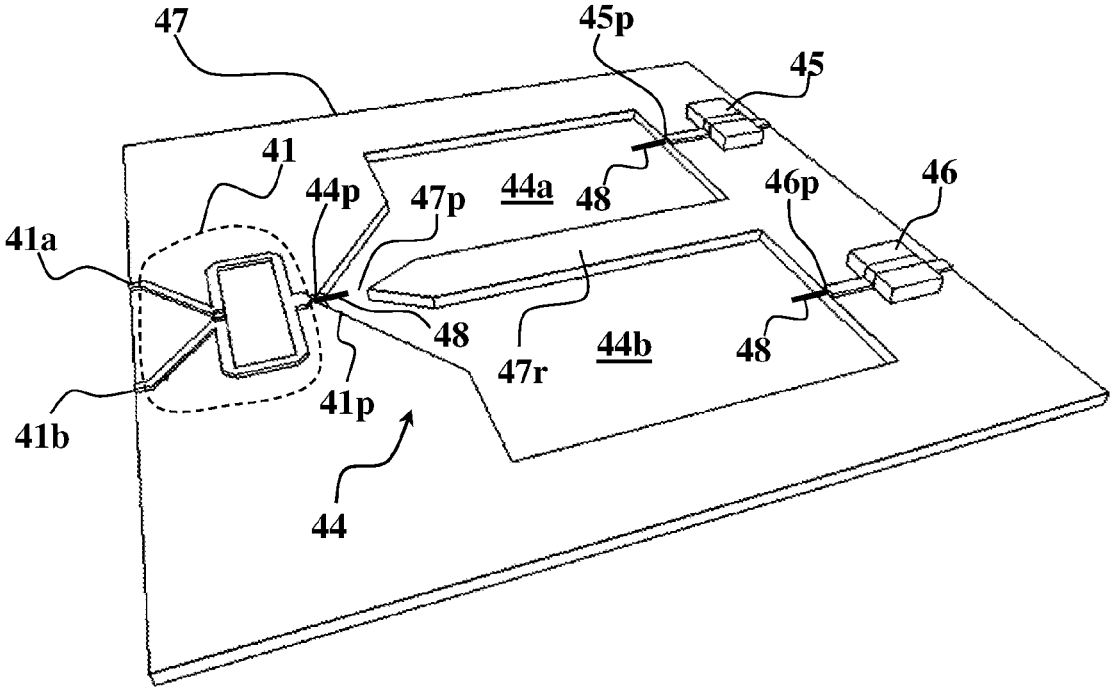

FIGS. 4A and 4B schematically illustrate combining several components and circuitries of a RF system 40 (FIG. 4A) in a multilayered structure according to some possible embodiments. FIG. 4A is a block diagram of the RF system 40 comprising a high power amplifier (HPA) 45 and a low noise amplifier (LNA) 46 connected to respective first and second ports, 45*p* and 46*p*, of a three-port duplexer 44, and a splitter/combiner 41 connected to a third port 41*p* of the duplexer 44. The splitter/combiner 41 comprises two ports

41*a* and 41*b* connectable to an external device(s) e.g., two antennas, and a single port 44*p* connected to the duplexer 44.

FIG. 4B shows structure and components of a flat board 47 in the multilayered resonant cavity structure according to some possible embodiments. The board 47 comprises the HPA 45 and LNA 46 mounted thereto (e.g., using surface mounting techniques) and coupled to two respective openings 44*a* and 44*b* configured to form different resonant frequency cavities with a stack of other flat boards (not shown) having similar-shaped openings and stacked therewith, and a splitter/combiner 41 comprises two ports 41*a* and 41*b* connectable to an external device(s) e.g., two antennas, and is coupled to a common port 44*p* of the duplexed resonant frequencies cavities formed from openings 44*a* and 44*b*. In some embodiments the coupling is achieved at 45*p*, 46*p* and 44*p*, through a connected conductor/wire 48, or other probe, that extends into the cavity.

In this specific and non-limiting example, the openings 44*a* and 44*b* are formed spaced-apart and side-by-side in the board 47, with a connecting passage 47*p* configured direct the electromagnetic waves to/from the common port 44*p*, from/to the cavities formed by the openings 44*a* and 44*b*. As exemplified in FIG. 4B the openings 44*a* and 44*b* can be separated by a partitioning segment 47*r* extending from one side of the board 47 and having a free end tapering towards the common port 44*p* i.e., towards the other side of the board 47. The portion of the board 47 wherein the common port 44*p* is located can also have a tapering configuration coaxially coinciding with the tapering end of the partitioning segment 47*r*, and having the common port 44*p* located in front of the vertex of the partitioning segment 47*r*.

The openings 44*a* and 44*b* can be prepared with electrically layers (2*f*) applied on/about the openings, as described hereinabove. In a bottom layer (not shown) to the flat board 47 in the respective locations of the components 45, 46 and 41, a full board or a hollowed board (to reduce weight) can be used. In one or more layers (not shown) upper to flat board 47, in the respective locations of components 45, 46 and 41, in order to provide a mechanical space, respective opening are provided, such that they will not touch the components 45, 46 and 41, and/or affect their performance. One or more full hoards (i.e., not having openings), or apertured boards (not shown), as may be required due to various considerations, such as weight or other required components, can be then attached on top of the structure.

Figure 5A:
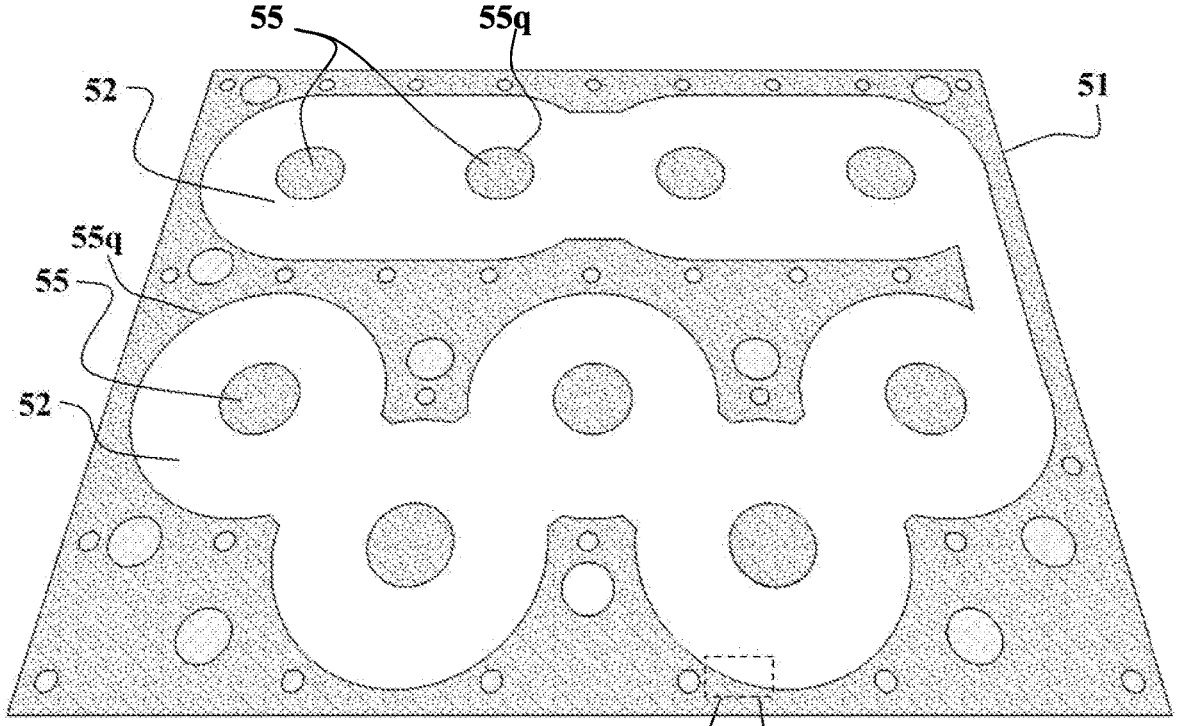
FIGS. 5A and 5B schematically illustrate construction of multilayered resonant cavities using flat boards comprising networks of metal filled/coated perforations, wherein FIG. 5A exemplifies a flat board comprising perforation networks configured to form a plurality of cavities, rods and tuning posts.
Figure 5B:
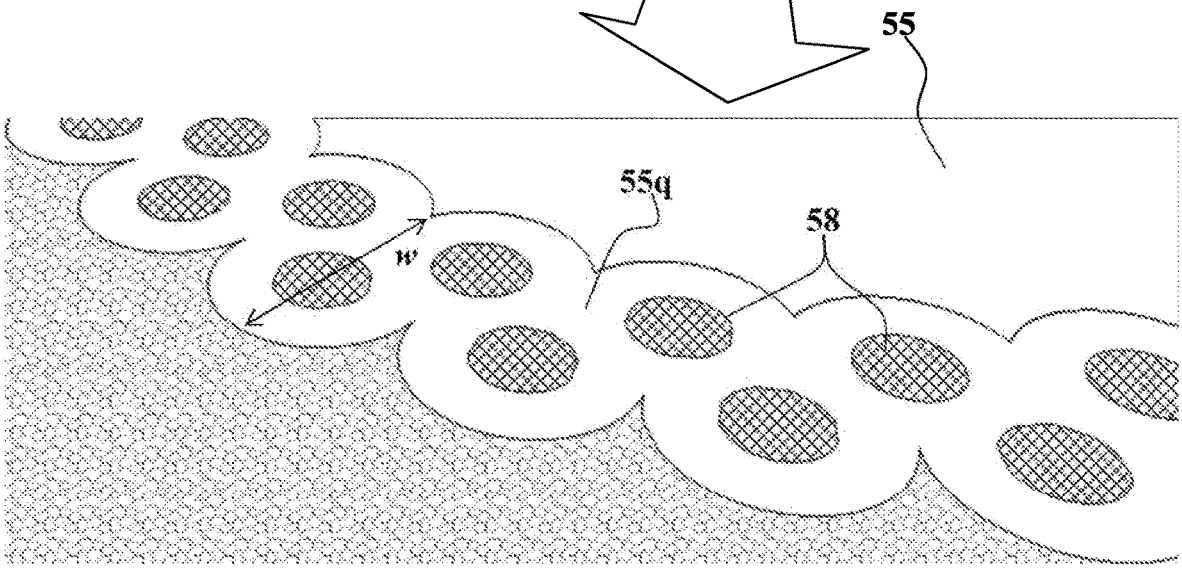

FIGS. 5A and 5B schematically illustrate construction of multilayered resonant cavities using flat boards 51 comprising networks of metal filled/coated perforations 55*q* (also referred to herein as vias). With reference to FIG. 5A, in this embodiment instead of forming openings in the flat board 51, the flat board is processed to include networks 55*q* of metal filled/covered vias arranged along areas of the board 51, forming cross sections 52 of resonant cavities of the apparatus, and portions of rods 55 thereof. The areas of the flat board 51 outside the cavity area 52 is covered by electrically conducting material, or at least its edge, such that electromagnetic barrier is formed by the network of vias preventing electromagnetic radiation from exiting the cavity (52). The vias are arranged such that continuous electrical conductions is obtained between the vias networks along a multilayered structure formed by stacking the flat boards one on top of the other.

In this way non-hollow cavity structures can be formed by stacking a plurality of the flat boards 51 one on top of the other, and placing covering boards (not shown) having one or more regions covered by one or more layers made of electrically conducting material configured to cover the formed non-hollow cavities, and establish electrical conduction with the vias networks 55*q*. Accordingly, the resonant cavities formed by the stacking of the flat boards 51 one on top of the other, are filled by the dielectric/diamagnetic material from which the flat boards 51 are made. The vias networks 55*q*, and the one or more layers made of electrically conducting material of the cover boards, are configured to reflect electromagnetic radiation introduced into the non-hollow resonant cavity apparatus. In other possible embodiments, multilayered cavities are formed using both apertured flat boards and flat boards 51 (FIG. 5A) with the networks of vias.

FIG. 5B shows a close-up of possible structure of vias networks 55*q*. In this specific and non-limiting example two interleaved sequences of filled and/or coated vias 58 are shown. In this configuration the vias 58 are filled with electrically conducting material and peripheral regions of each via 58 is covered/coated by the electrically conducting material. This way continuous electrically conducting regions having a width w, are formed along and in the boards. The vias 58 can be plated micro-drills having diameter of about 0.01 millimeters to tens of millimeters, and they can be arranged to form two or more interleaved sequences of vias having a width w of about 0.01 millimeters to tens of millimeters. These "conductive holes" are electrically connected among themselves to form an imaginary conductive wall for reflecting the electromagnetic radiation introduced into the non-hollow cavity thereby formed.

The flat boards can be made from any material having suitable dielectric/diamagnetic properties, but in some embodiments, they are implemented by PCBs, e.g., made of FR4 for RF applications. In some embodiments the flat boards 51 can be manufactured from materials that reduce losses relative to materials such as FR4, such as manufactured by Rogers Corporation, 2225 W. Chandler Blvd. Chandler, AZ 85224 Phone: 480.917.6000 877.643.7701 Fax: 480.857.2819 or Taconic Headquarters, Advanced Dielectric Division, 136 Coonbrook Road, Petersburgh, NY 12138, United States. The techniques disclosed herein provides the designer the option to decide whether to cut the dielectric material of the flat boards out by forming the openings, such that the dielectric material filling the cavities will be air, or another gas, or vacuum, depends on what atmosphere the multilayered structure is closed in, and/or whether to use the material of the flat boards/PCBs as the filling dielectric material of the cavities. Using the dielectric material of the flat/boards/PCBs as the filler of the cavities results in shorter wavelengths of the cavity resonator, which serve to reduce the volume/size of cavity structure.

It is noted that this cavity structure formation technique, utilizing flat hoards 51 comprising electrically conducing vias networks 55*q*, can be similarly used to integrate additional components and/or circuitries directly on/in the multilayered structure, as exemplified in FIG. 4B e.g., two ports combiner/splitter, amplifiers, filters, and/or other mounted electric/electronic components.

Figure 6A:
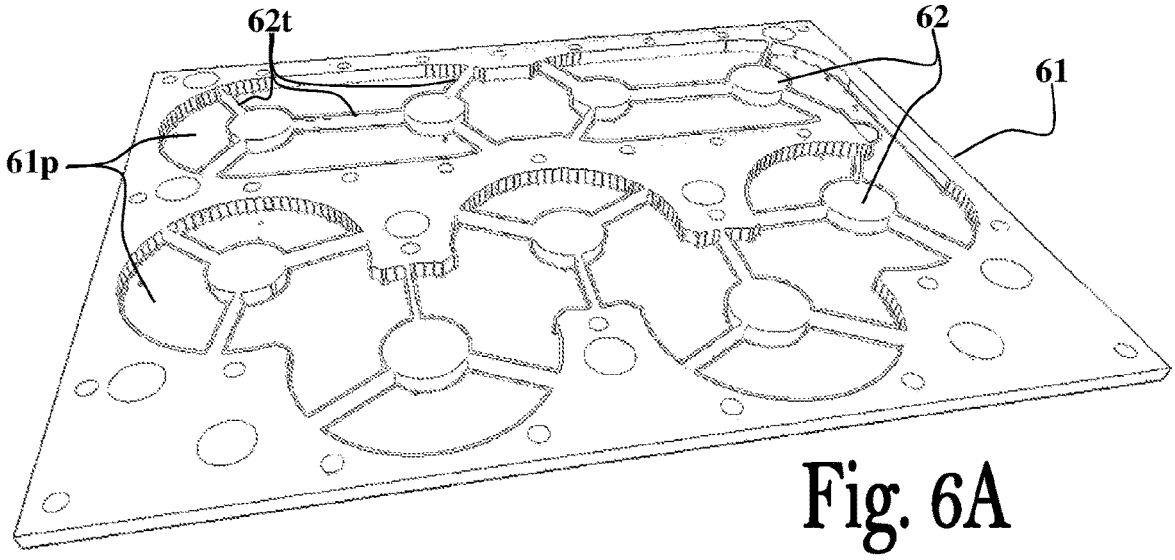
Figure 6B:
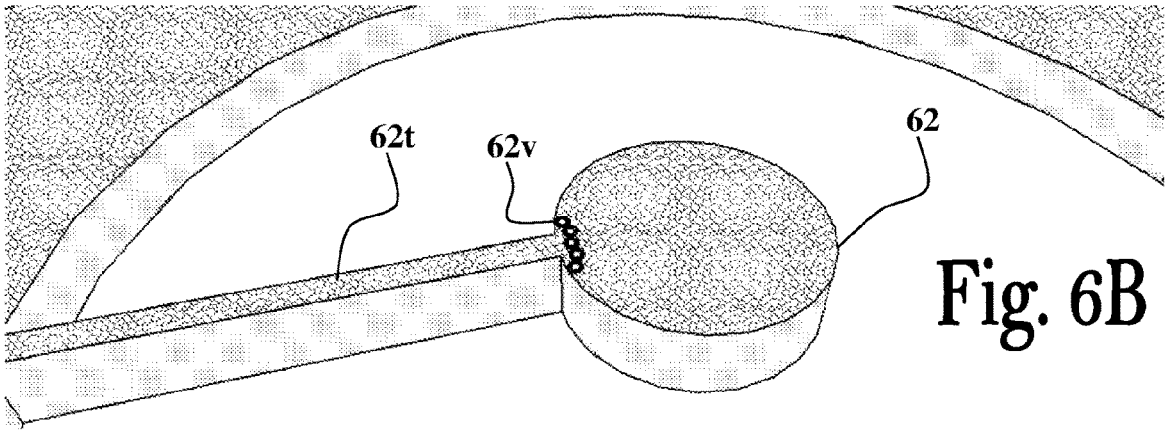
Figure 6C:
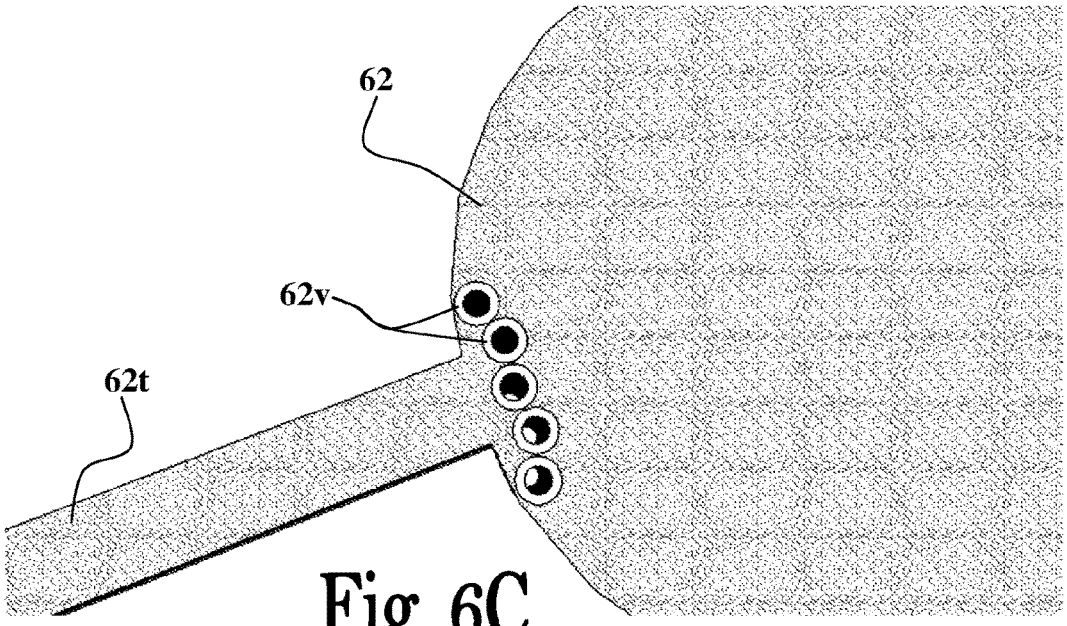

FIGS. 6A to 6C schematically illustrate construction of a multilayered cavity structure from flat boards 61 having openings 61*p* configured to form cavities by stacking a plurality of the flat boards 61 one on top of the other as shown in FIG. 6A. The flat boards includes attachment arms 62*t* configured to hold in the formed openings a portion of a rod and/or tuning post and/or other electrically conductive coated structure 62. Accordingly, stacking of the flat boards 61 one on top of the other forms a plurality of cavities by openings 61*p*, each having a central rod formed by the rods portions 62. The walls of the formed cavities and of the tuning posts are covered by one or more layer of electrical conducing materials for reflecting electromagnetic radiation. The electrically conductive coating process can be part of the PCB manufacturing process. Optionally, one or more additional electrically conducting coatings can be applied after assembling all the layers together. The multilayered structure formed by the boards 61 is then closed by covering boards having one or more regions coated by one or more layers of electrically conducting materials configured to cover the formed cavities and establish electrical conduction with the electrical conducing materials coating the walls of the cavities and of the rods and/or tuning posts.

FIGS. 6B and 6C exemplifies use of metal filled/coated perforations 62*v* for reflection of electromagnetic radiation from the sections of rod portions 62 that connect to the attachment arms 62*t*. The other end of the attachment arm of 62*t* connected to the body of the board 61 can comprise similar metal filled/coated perforations 62*v* for reflection of electromagnetic radiation, such that the electromagnetic radiation introduced into the formed cavity interacts with a cavity and rods having walls coated with electrically conducting layers, and with a small dielectric attachment arms located inside the cavity. The perforations 62*v* can be metal filled/coated vias/micro-drills, made as described herein above, to form an imaginary wall configured to reflect electromagnetic radiation. In some embodiments the multilayered rod and/or tuning posts structure obtained have a (hollow or solid) cylindrical shape, but other shapes can be similarly used.

When constructing a multilayered cavity structure from flat boards having openings configured to from the cavities, as shown in FIGS. 2A to 2C, the rods and/or tuning posts can be added to the multilayered cavity structure at a later stage, as carried out in conventional cavity resonators. For example, by connecting the rods and/or tuning post to the top, or bottom, covering flat board (21 or 25 in FIG. 2A). Alternatively, the rods and/or tuning posts can be multilayered structures formed by portions of the flat boards, as exemplified in FIGS. 5A, 5B and 6A, 6B and 6C, whereby the multilayered rods and/or tuning posts are structured by the same manufacturing process used to form the cavities.

Figure 7:
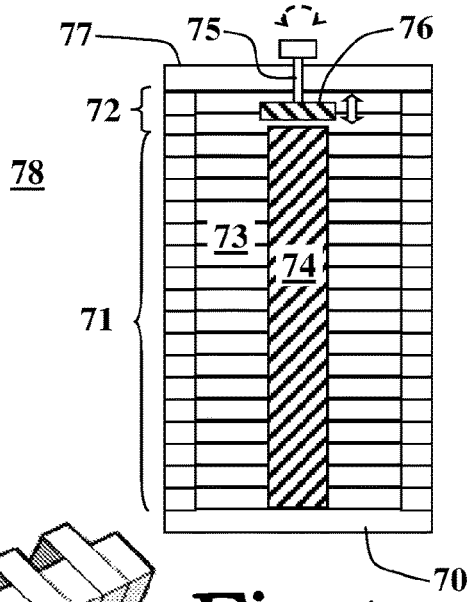
FIG. 7 schematically illustrates a tuning post arrangement according to some possible embodiments.

FIG. 7 schematically illustrates a tuning post arrangement provided in the multilayered cavity structure 78 according to some possible embodiments. The cavity structure 78 can be made using only apertured flat boards (i.e., boards having at least one opening 73 with conductive material applied thereto), or from a combination of apertured flat boards and flat boards having networks of vias filled/coated by electrically conducting material. For example, a bottom section 71 of the cavity structure 78 can be assembled using either apertured flat boards stacked one on top of the other with a bottommost flat board 70 having one or more regions of electrically conducting material configured to cover the bottom side opening of the opening 73 with a central tuning post/rod 74 attached to it (e.g., by a screw), or by flat boards having networks of vias filled/coated by electrically conducting material an configured to form a non-hollow cavity and a central tuning post/rod 74, as described hereinabove.

An upper portion 72 of the cavity structure 78 is made from apertured flat boards forming a hollow cavity 73 and configured to accommodate a tuning plate 76 made of an electrically conducting material. The tuning plate 76 is movable attached to the topmost flat board 77 by a tuning screw 75 configured for elevating or lowering the tuning plate 76 by threads provided in the topmost flat board 77.

Figure 8B:
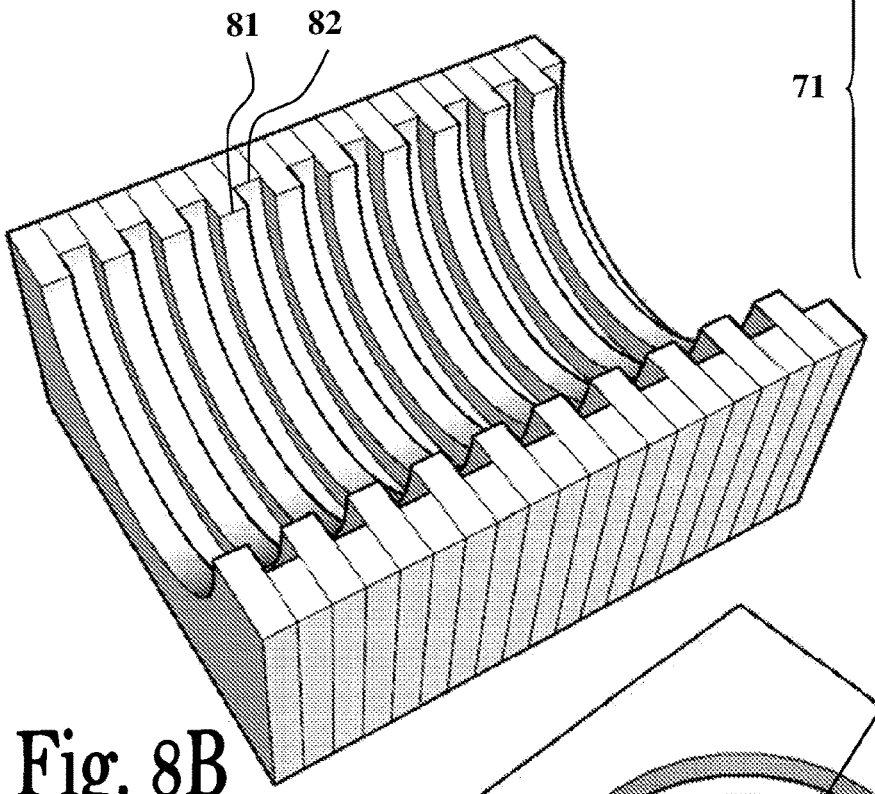
Figure 8A:
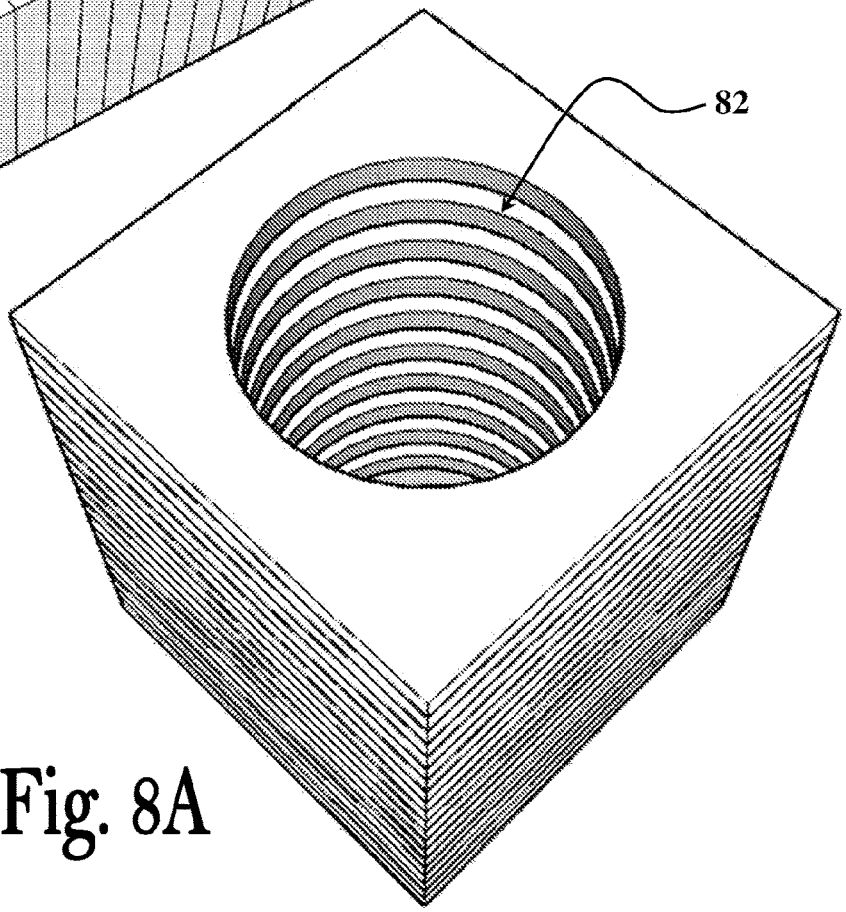

FIGS. 8A and 8B schematically illustrate construction of a waveguide 80 (FIG. 8A) according to some possible embodiments. The corrugated circular waveguide 80 can be made using only apertured flat boards (i.e., boards having at least one opening with conductive material applied thereover and thereabout), from flat boards having networks of vias filled/coated by electrically conducting material, or from a combination of apertured flat boards and flat boards having networks of vias filled/coated by electrically conducting material. In this specific and non-limiting example, the cavity 82 is formed by apertured flat boards having openings of two different diameters, placed one on top of the other to form a circular cavity having a wall with a corrugated cross-section. The openings surface and surroundings are plated with electrically conducting material, and the corrugated shape of the cavity walls configuration to provide desired properties of the cavity device. For example, this corrugated cavity configuration is used in some embodiments to reduce the geometrical dimensions of the cavity device.

In some possible embodiments not all of the openings of the apertured flat boards comprise electrically conducting material applied over and about their opening. For example, in the jagged wall cavity configuration of the waveguide 80 in FIGS. 8A and 8B, the electrically conducting layer of the cavity walls can be applied only over and about the openings of boards 81 having the smaller diameter e.g., i.e., if the flat boards are implemented by PCBs, the dielectric material of the PCB (e.g., FR4 available from Rogers Corporation, 2225 W. Chandler Blvd. Chandler, AZ 85224 Phone: 480.917.6000 877.643.7701 Fax: 480.857.2819) of the openings of boards 82 having the greater diameter interacts with electromagnetic radiation inside the cavity. In such configurations a circular wave guide is obtained that acts like a filter by suppressing the modes that are not in the order of $TE_{0n}$ (where n=1, 2, 3 . . . is and integer e.g., it suppress the $TM_{11}$ and does not attenuate the $TE_{01}$ (modes of circular waveguide). Such configurations provide waveguide structure than can be bent over a radius. Alternatively, the electrically conducting layer of the cavity walls can be applied only over and about the openings of boards 82 having the greater diameter.

Figure 9:
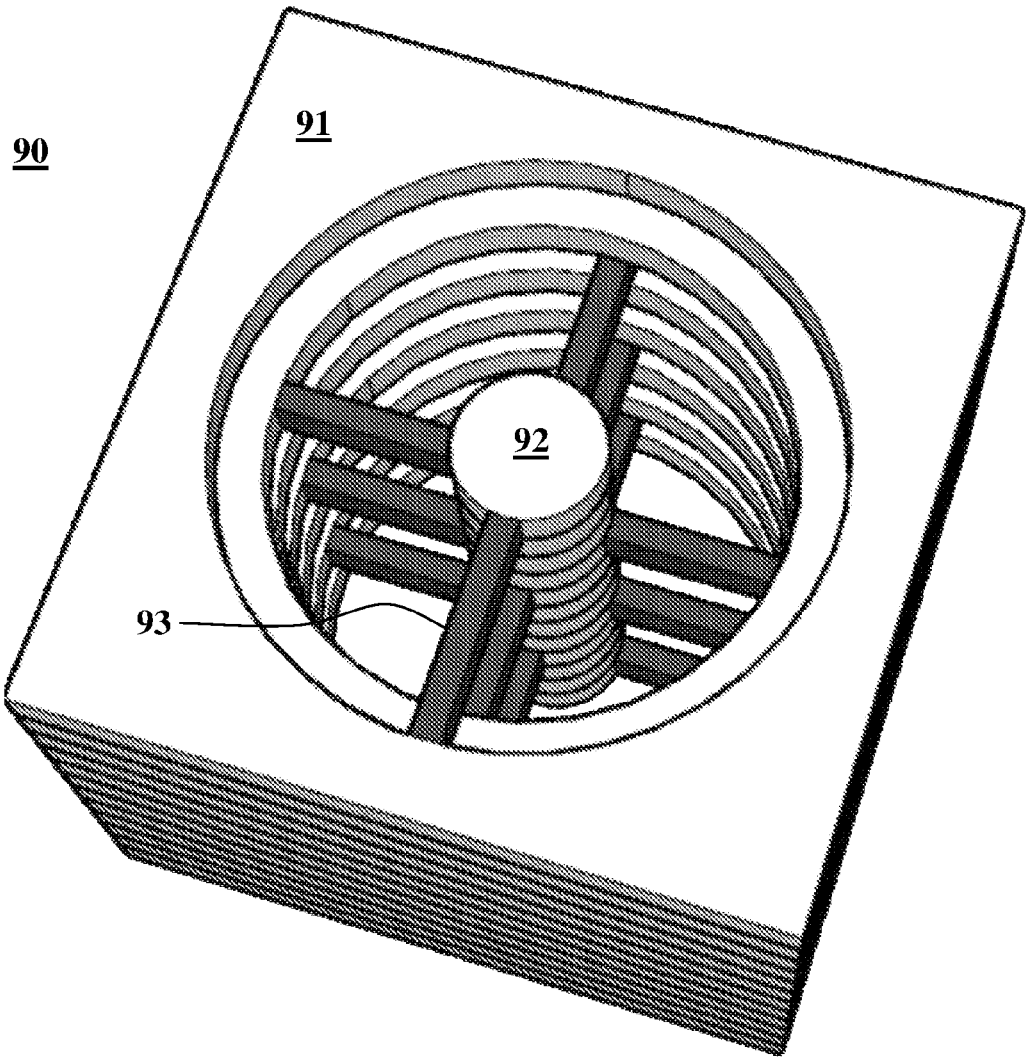
FIG. 9 schematically illustrates construction of a coaxial transmission line according to some possible embodiments.

FIG. 9 schematically illustrates construction of a coaxial transmission line 90 according to some possible embodiments. In this non-limiting example, the coaxial device 90 is structure from a plurality of aperture flat boards 91, each having a circular opening and a central rod/post portion 92 attached to the flat board by an integral attachment arm 93. The ends of the attachment arm 93 comprise in some embodiments vias filled/coated by electrically conducting material, as shown in and described with reference to, FIGS. 6B and 6C. as shown, the flat boards 91 can be placed one on top of the other with 90° shifts, such that the attachment arm 93 of each consecutive flat board 91 placed on the stack is 90° shifted with respect the attachment arm 93 of a previously placed flat board 90. Optionally, flat boards 91 comprises opening of two different diameters, and the boards are stacked one on top of the other to form a cavity having jagged shaped wall, such as shown in FIGS. 8A and 8B.

Figure 10E:
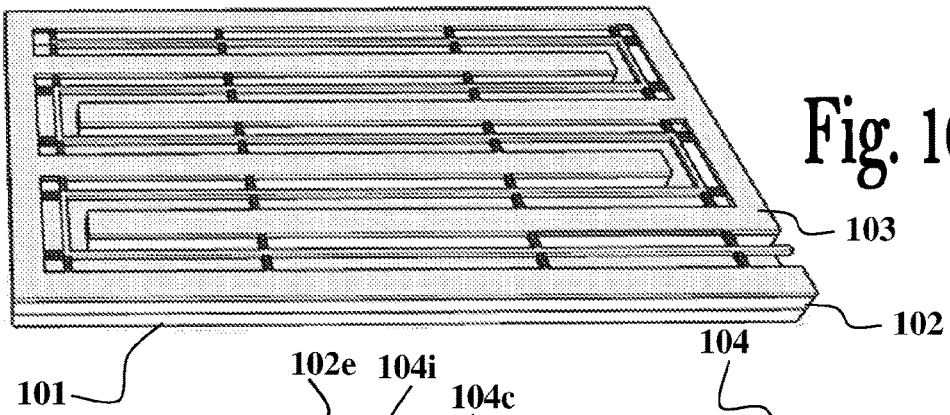

FIGS. 10A to 10H schematically illustrate construction of a multilayered delay line 100 according to some possible embodiments. The multilayered delay line 100 is constructed to form a rectangular coaxial waveguide structure by stacking five flat boards 101, 102, 103, 104, and 105, one on top of the other. FIG. 10A shows the bottommost flat board 101, and FIG. 10B shows a bottom channeled board 102 having two sets of elongated arms 102*a* extending one towards the other from opposite sides of the board in an interlacing manner to thereby form a zigzagged passage 102*p* starting at a lateral opening 102*n* and having a closed ending at 102*e* (in the plane of the board). The bottom channeled board 102 is stacked on top of the bottommost flat board 101, as shown in FIG. 10C.

FIG. 10D shows a channeled coaxial flat board 103, configured to form a zigzagged passage 102*p*, substantially as in board 102, and comprising an electrically conducting line 103*c* held centered inside the zigzagged passage 102*p* by a plurality of attachment arms 103*m*. Both, the electrically conducting line 103*c* and the plurality of attachment arms 103*m*, can be integral parts of the board 103. FIG. 10E shows the multilayered structure after stacking the channeled coaxial flat board 103 board on top of the previously stacked boards 101 and 102.

Figure 10F:
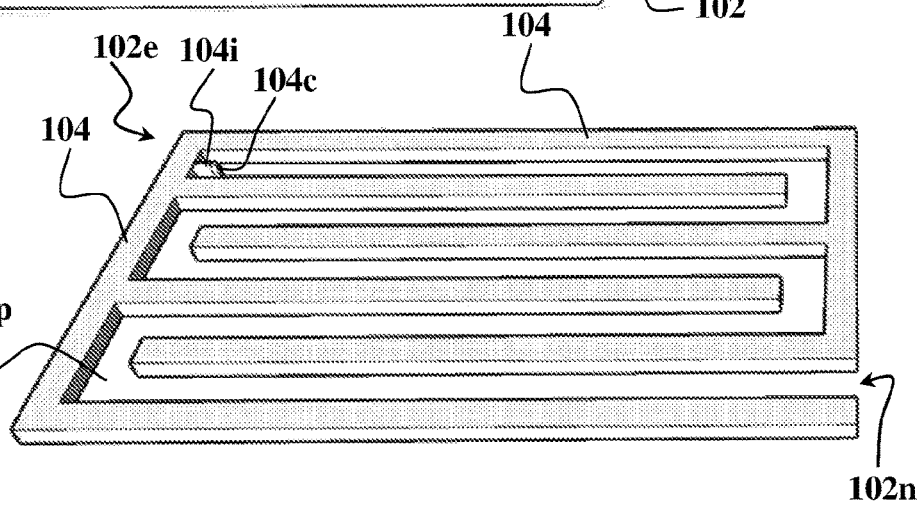
Figure 10G:
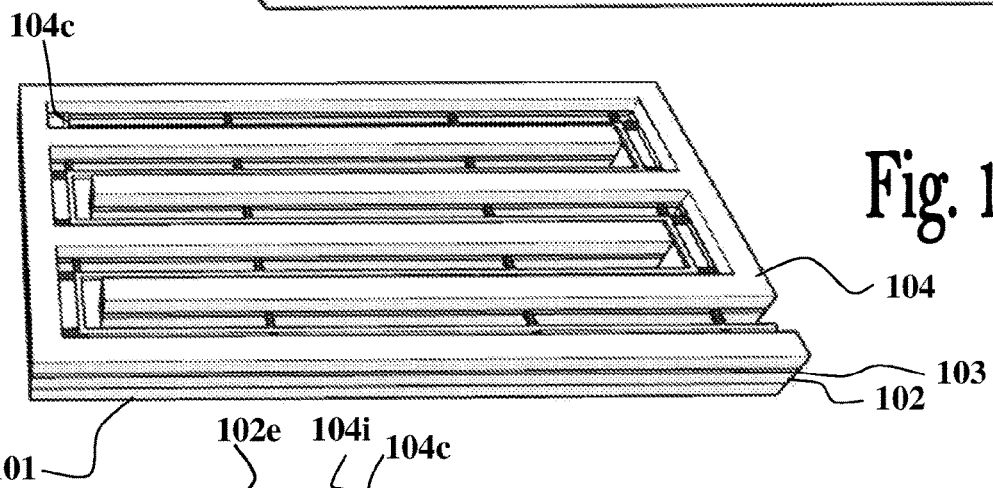

FIG. 10F shows a top channeled board 104, configured to form a zigzagged passage 102*p*, substantially as in board 102, and comprising at its closed end 102*e* of the zigzagged passage 102*p* an electrical conductor 104*c* formed over an edge of a small piece of the board 104*i* inwardly extending into the end part of the zigzagged passage 102*p*. FIG. 10G shows the multilayered structure after stacking the top channeled flat board 104 on top of the previously stacked boards 101, 102 and 103, with its electrical conductor 104*c* electrically connected to the one end of the electrically conducting line 103*c* of the channeled coaxial flat board 103.

Figure 10H:
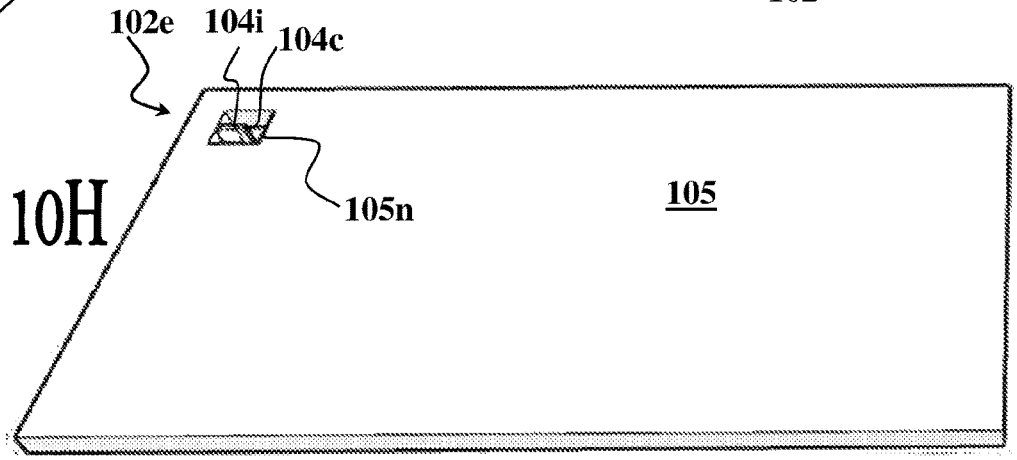
Figure 10I:
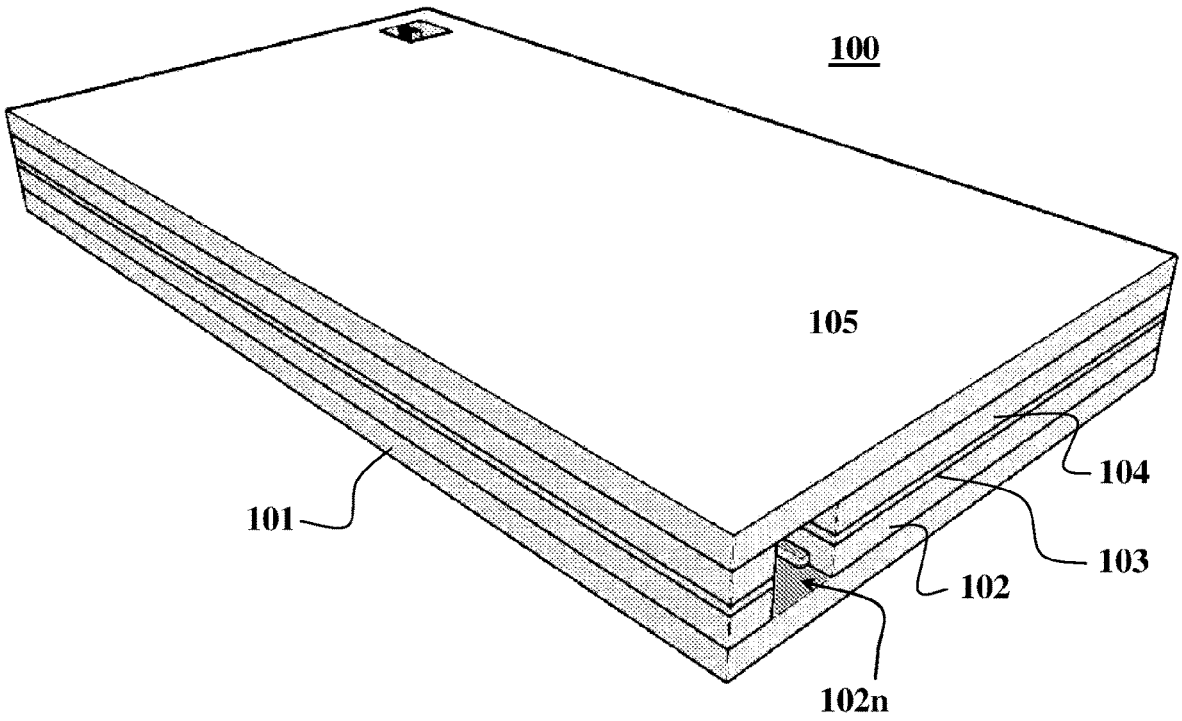

FIG. 10H shows the topmost layer 105 of multilayered delay line 100, and FIG. 10I shows the multilayered delay line 100 after stacking a topmost flat board 105 on top of the multilayered structure shown in FIG. 10G. The topmost flat board 105 covers almost all sections of the zigzagged passage 102*p*, except for a part of the end section 102*e*, which is accessible via an opening 105*n* formed in the topmost flat board 105 as shown in 10H, thereby forming a first signal port of the delay line 100. Portions of the different flat boards 101 to 105, as shown in 10I are covered with one or more layers of electrical conducting material, as described herein above, for plating the walls of the zigzagged channel formed by the channeled boards 102, 103 and 104. The lateral opening formed by the lateral 102*n* opening of the zigzagged passage 102*p* the channeled boards 102, 103 and 104, forms a second signal port of the delay line 100.

In some embodiments the ends of the plurality of attachment arms 103*m* (FIG. 10D) includes vias filled/coated by electrically conducting material, as shown in and described with reference to, FIGS. 6B and 6C. Optionally, the electrically conducting line 103*c* is implemented by an electrically conducting wire connected to the attachment arms 103*m*. In another possible embodiment, channel the electrically conducting line 103*c* is implemented by an electrical wire centrally held inside the zigzagged channel of the delay line 100 by a dielectric material filling the channel.

Figure 11A:
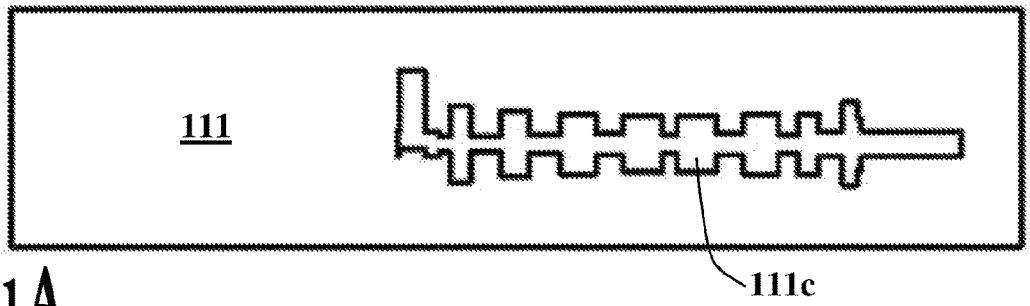
FIGS. 11A to 11D schematically illustrate construction of a rectangular waveguide duplexer according to some possible embodiments.
Figure 11B:
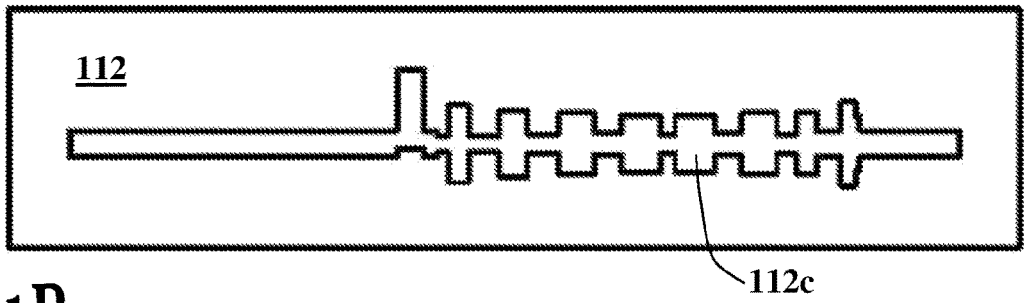
Figure 11C:
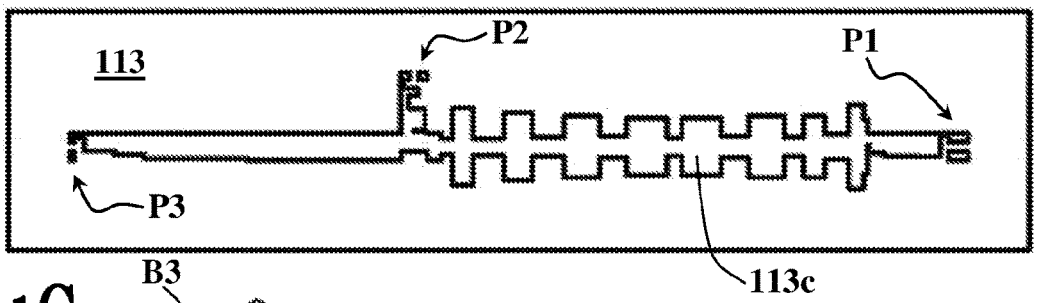
Figure 11D:
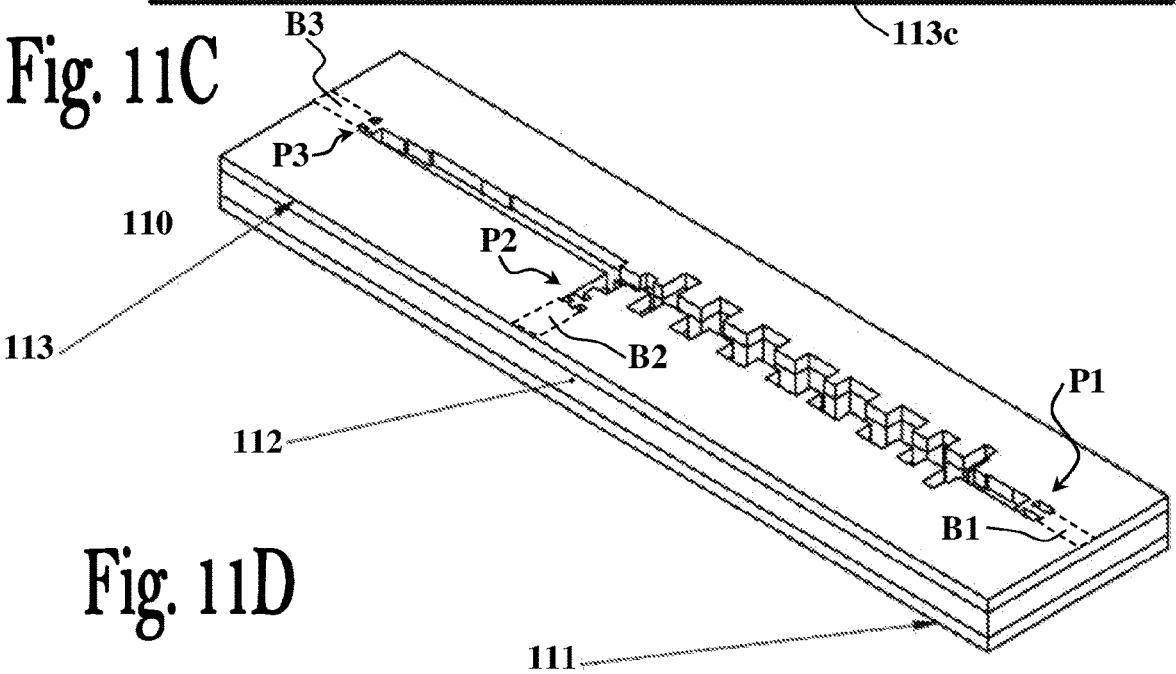

FIGS. 11A to 11D schematically illustrate construction of a rectangular waveguide duplexer 110 according to some possible embodiments. The multilayered duplexer 110 is made from a stack of the apertured boards 111, 112 and 113, placed one on top the other to form an internal channel. The multilayered duplexer 110 is made in some embodiments stacking a first instance of board 112 on first instance of board 111, stacking board 113 on top of the first instance of board 112, stacking a second instance of board 112 on board 113, and stacking a second instance of board 111 on the second instance of board 112, thereby forming an internal channel as the patterned openings 111*c*, 112*c* and 113*c*, of the boards 111, 112, 113 respectively as respectively shown in FIGS. 11A, 11B and 11C are connected as shown in FIG. 11D. The internal channel is then closed by placing topmost and bottom most layers (not shown) over the top and bottom sides of the multilayered structure. The boards 111, 112 and 113, are covered entirely, or partially, by electrically conducting material for reflection of electromagnetic radiation introduced into the internal channel.

FIG. 11D shows part of the multilayered structure obtained by the stacking of the first instances of boards 111 and 112, and of board 113, one on top of the other. as shown, the central board 113 comprises three pairs of pass-through slits P1, P2 and P3, located at signal ports of the multilayered duplexer 110. One pass-through slit of each pair of slits is connected to the patterned opening 113*c*. Three respective bores/opening B1, B2 and B3, are formed in the central board 113, towards pass-through slits P1, P2 and P3, electromagnetically coupling the multilayered duplexer 110 to external signal sources/recipient's devices. A coaxial connector can be placed in each of the bores/openings B1, B2 and B3, by inserting a coaxial connector into the formed bore/opening such that its internal coaxial lead is connected to the metal coating electrically conducting material applied on the board 113 at the area between the respective pair pass-through slits P1, P2 and P3.

Figure 12A:
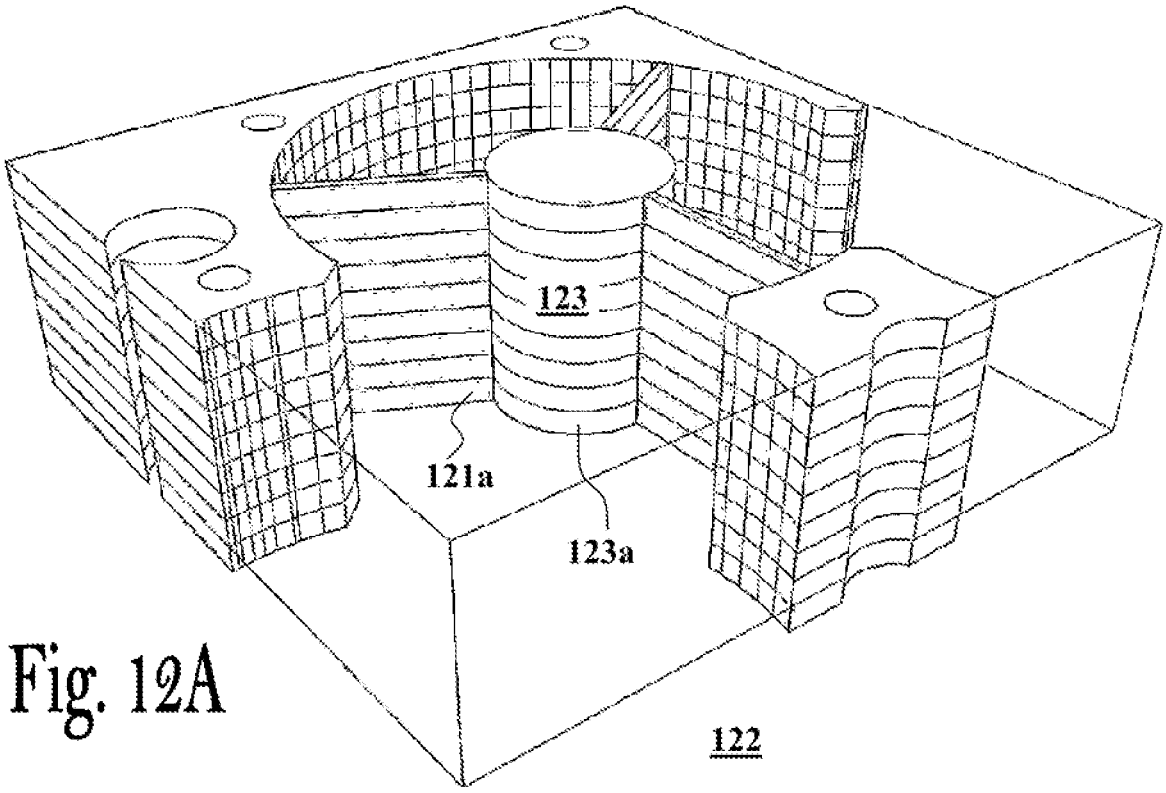
FIGS. 12A to 12F schematically illustrate various techniques for constructing a rod/post inside a multilayered cavity device according to some possible embodiments.
Figure 12B:
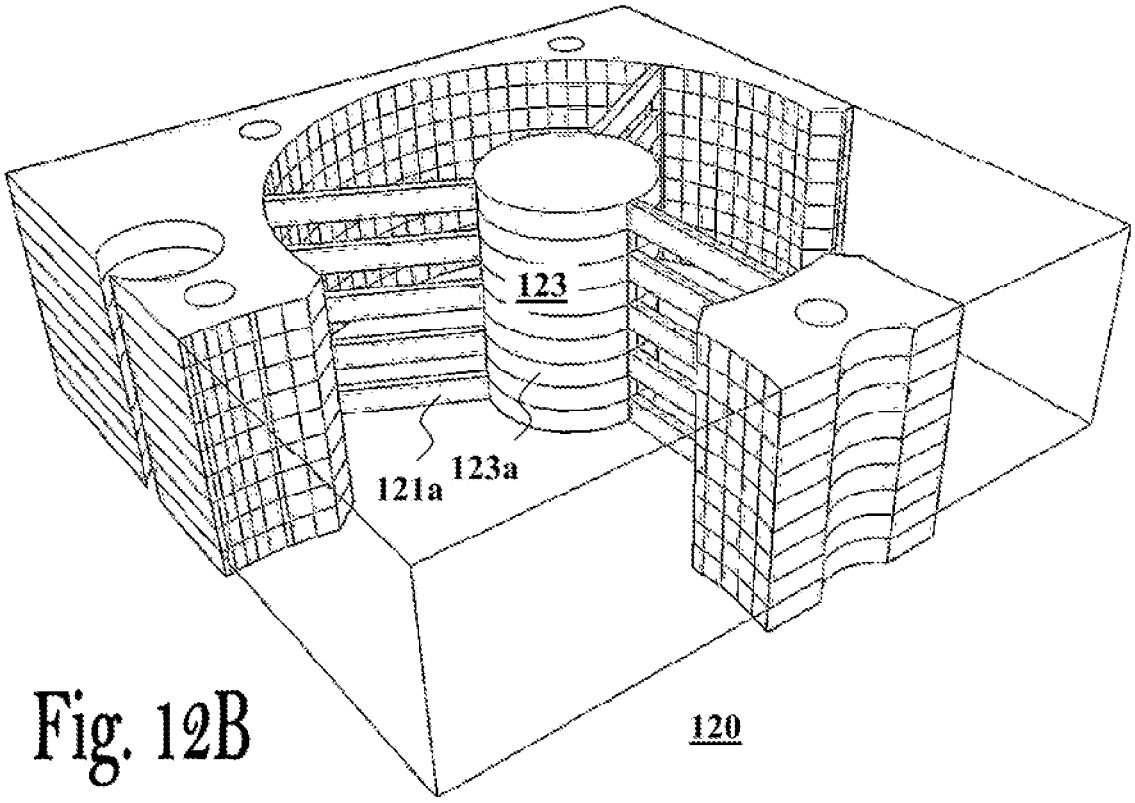
Figure 12C:
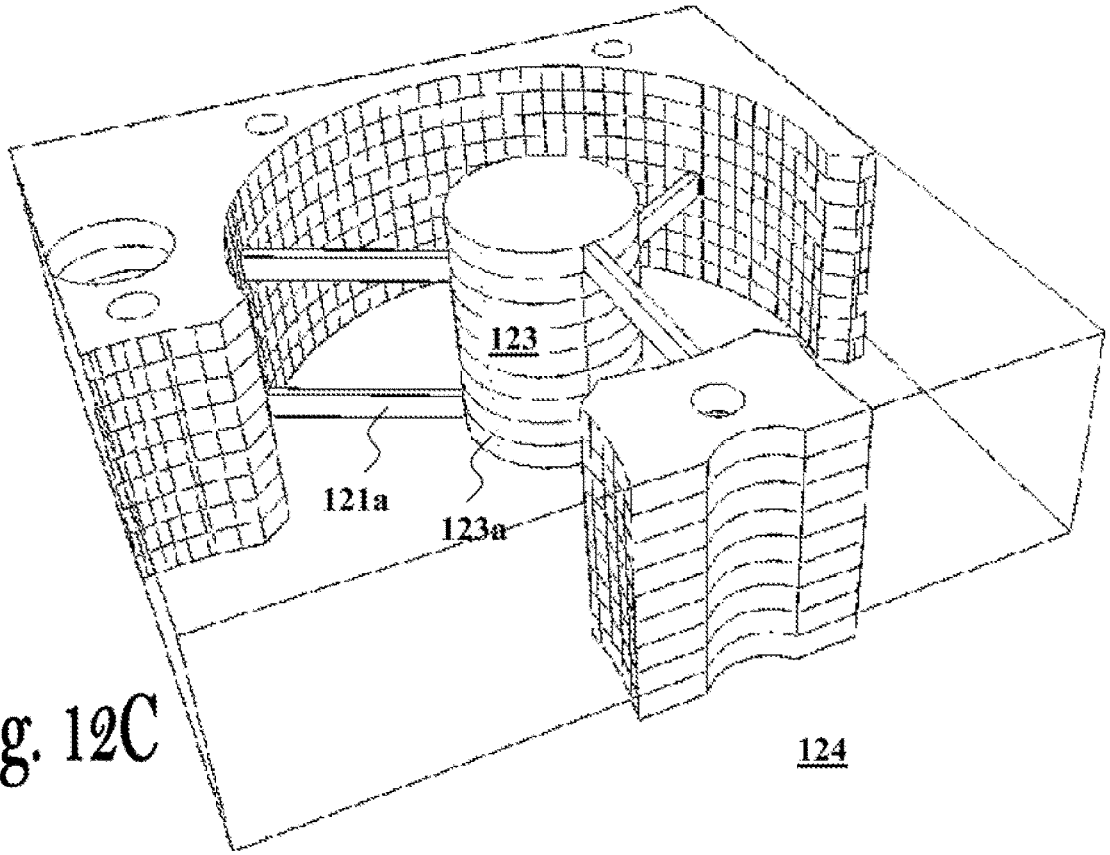
Figure 12D:
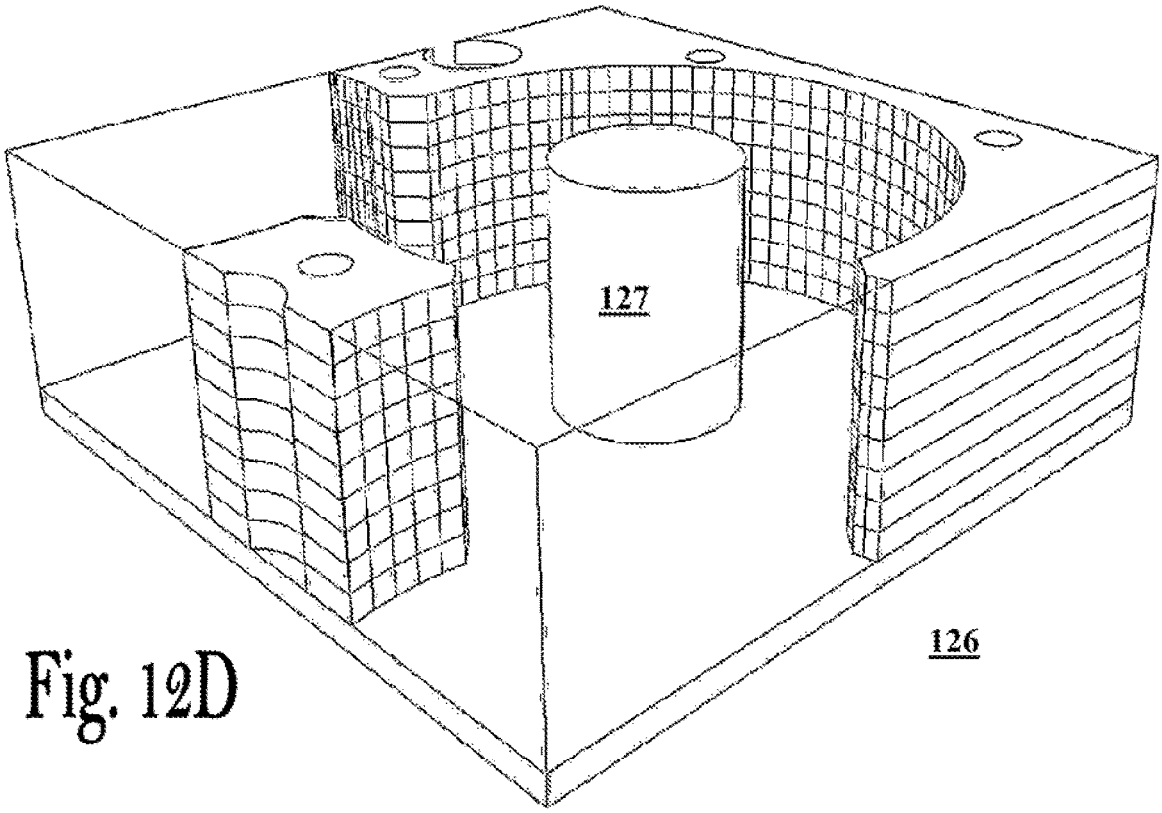
Figure 12E:
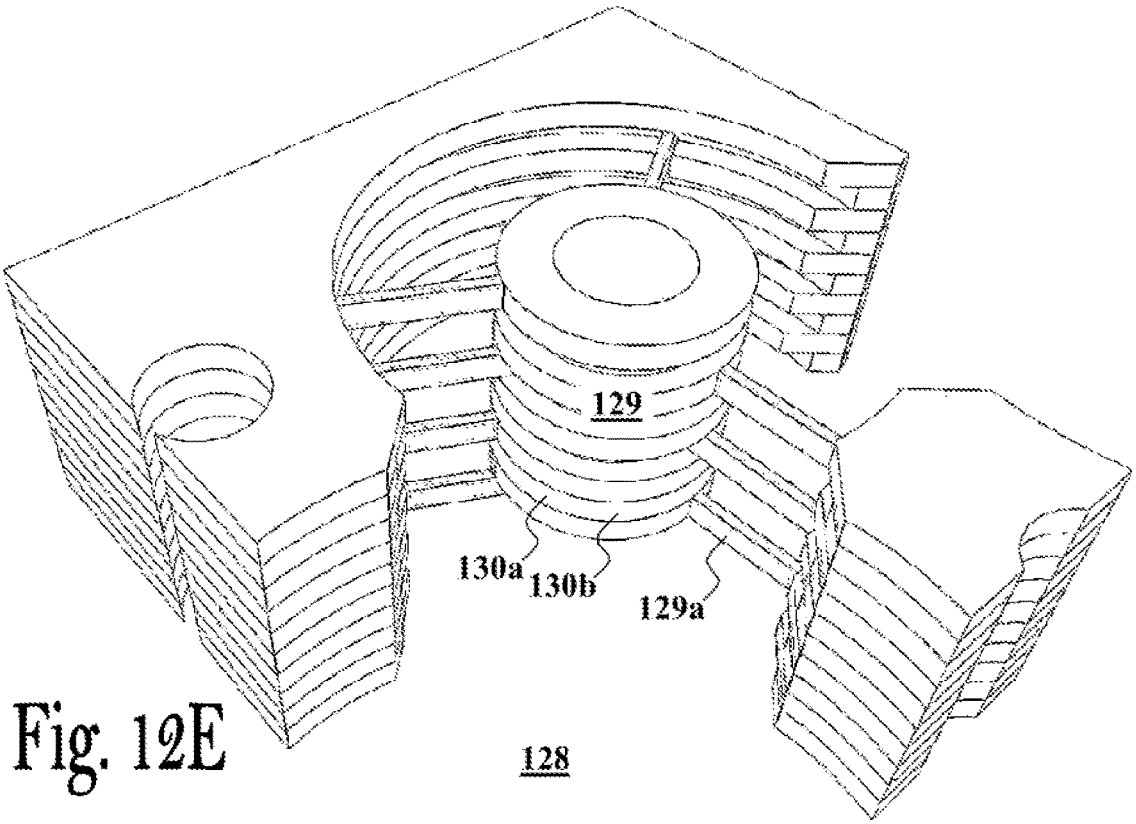
Figure 12F:
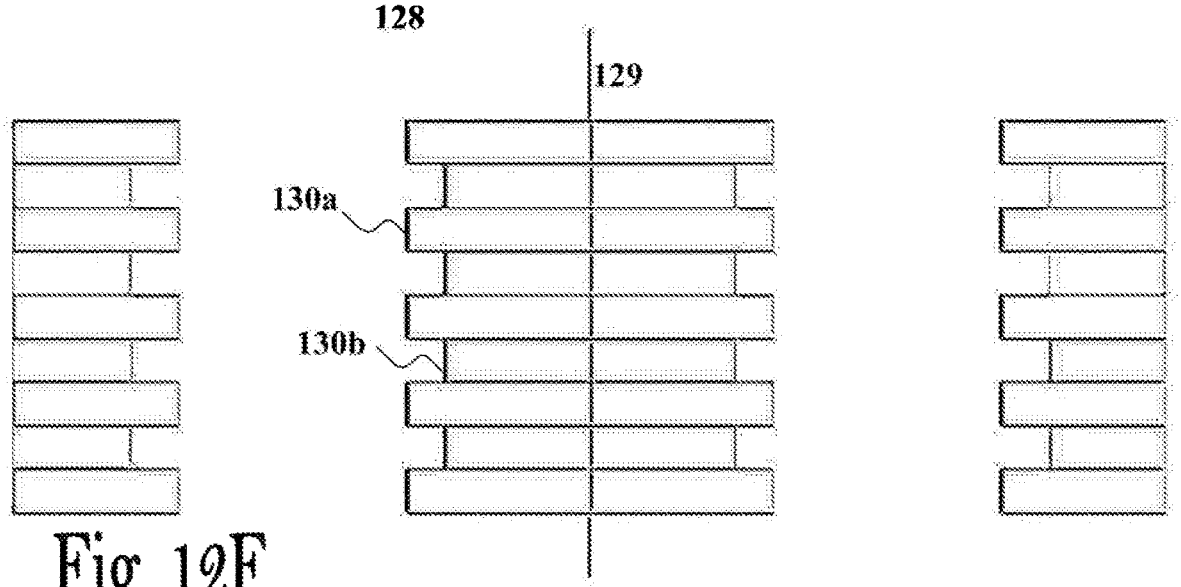

FIGS. 12A to 12F schematically illustrate various techniques for constructing a rod/post inside a multilayered cavity device according to some possible embodiments. FIG. 12A shows a multilayered cavity device 122 having a central rod/post 123 constructed entirely by rod/post portions 123*a* held by attachment arms 121*a*. FIG. 12B shows a cavity device 120 having central rod/post 123 which only some of the rod/post portions 123*a* are held by attachment arms 121*a*, while other rod/post portions 123*a* are attached during the construction process manually. FIG. 12C shows construction of a central rod/post 123 of the cavity device 124 using fewer attachment arms 121*a*, and the central rod/post 127 of the multilayered cavity device 126 shown in FIG. 12D is a cylindrical element attached (e.g., by a screw) to the bottommost layer.

FIGS. 12E and 12F exemplify construction of the cavity device 128 with a jagged walled cavity structure and jagged central rod/post 129 using attachment arms 129*a* (FIG. 12E) to hold the rod/post portions having the greater diameters 130*a*, while the rod/post portions having the smaller diameters 130*b* are attached separately (e.g., manually).

In the embodiments showing use of attachment arms to place rod/post portions networks of vias filled/coated by electrically conducting material can be used at the ends of the attachments arms for reflecting electromagnetic radiation, as described and shown in FIGS. 6B and 6C.

As described hereinabove and shown in the associated figures, the present invention provides multilayered cavity structures, and methods of fabricating the same. Some advantages of the multilayered cavity (RF/electromagnetic) structures over conventional resonator cavities, are, inter alia:

- weight reduction: the weight of the multilayered cavity structures disclosed herein is substantially smaller compared to the weight of the conventional milled/drilled metal alloy (e.g., aluminum or brass) elements.
- Reduced costs: manufacturing the multilayered resonant cavity structures disclosed herein from PCBs in mass production is very cost effective. Metallization processes customarily used in PCB production processes can be used to form the reflective walls of the cavities, which is a major advantage. The costs of the PCB materials and of the related, opening formation, plating and attachment processes, are significantly cheaper than the costs of the martials used to manufacture conventional resonator cavities.

Environmentally friendly: significant reduction in usage of materials and resources.

Technological: using of PCBs to manufacture the parts of multilayered cavity structures enable direct mounting and coupling of electric circuitries and/or other active/passive components (e.g., low noise amplifier, splitters, power amplifiers, switches, filter and any other on board PCB or cavity components) directly on the PCB itself, which substantially improves system performance due to the direct connection (without cable loss), and significantly reduces system form factor. Applying the techniques disclosed herein permits use of a variety of RF communication channels such as coplanar micro strip, waveguide etc., mounted on or in the multilayered cavity structures disclosed herein.

Using the flat board material to fill the cavities enable decreasing the geometrical dimensions of the cavity resonators, in which the radio frequency propagates according to the dielectric propagation velocity of the filling material. In addition, the multilayer design enables creating special resonance structures that are smaller than the regular ones, thereby reducing volume/size.

Usually the coupling mechanism to the resonator is hand prepared and possesses a heap of variations and needed to be manually set into proper position. The embodiments disclosed herein eliminated this problem by using an electrical conductor having a determined length and orientation.

The techniques disclosed herein can be used to form cavity structures having a myriad of orientations, allowing cavities extending in traversal and/or diagonal directions, which are not possible in the conventional manufacture techniques.

Terms such as "top", "bottom", "front", "back", "right", and "left" and similar adjectives in relation to orientation of the disclosed components, refer to the manner in which the illustrations are positioned on the paper, not as any limitation to the orientations in which the apparatus can be used in actual applications.

It should also be understood that throughout this disclosure, where a process or method is shown or described, the steps of the method may be performed in any order or simultaneously, unless it is clear from the context that one step depends on another being performed first.

While particular embodiments of the invention have been described, it will be understood, however, that the invention is not limited thereto, since modifications may be made by those skilled in the art, particularly in light of the foregoing teachings. As will be appreciated by the skilled person, the invention can be carried out in a great variety of ways, employing more than one technique from those described above, all without exceeding the scope of the claims.

The invention claimed is:

1. A method of constructing a cavity device, the method comprising:

preparing a plurality of boards at least some boards of said plurality of boards comprising one or more openings, each of said openings having interior edges at least partially coated by one or more layers of electrically conducting material;

subsequent to said preparing said plurality of boards, stacking said plurality of boards one on top of the other to form a multilayered structure forming a continuous electrical conduction between said one or more layers of electrically conducting material of said at least some boards, thereby forming a multilayered structures having at least one cavity formed therein, and placing at least one rod or tuning post in the at least one cavity.

2. The method of claim 1, further comprising fabricating at least some of the boards from at least one printed circuit board.

3. The method of claim 2, further comprising attaching one or more circuitry components to at least one of the boards.

4. The method of claim 3, further comprising electromagnetically coupling the one or more circuitry components to the at least one cavity.

5. The method of claim 1, wherein said at least some boards includes two or more boards and wherein said placing said at least one rod or tuning post is through at least one of said one or more openings in each of said two or more boards.

6. The method of claim 5, further comprising electrically isolating at least one of said at least one rod or tuning post from said interior edges of each said one or more openings.

7. The method of claim 6, further comprising providing an electrically isolating attachment arm to support at least one of said at least one rod or tuning post from at least one of said interior edges.

8. The method of claim 6, wherein at least one of said at least one rod or tuning post comprises a dielectric material.

9. The method of claim 8, further comprising making at least one electrically conducting perforation in at least one of said at least one rod or tuning post to establish a conductive layer surrounded by said at least one rod or tuning post.

10. The method of claim 1, further comprising covering an opening of the at least one cavity with an electrically conducting material.

* * * * *